US010125594B2

(12) United States Patent
Lewis et al.

(10) Patent No.: US 10,125,594 B2
(45) Date of Patent: Nov. 13, 2018

(54) PRESSURE EXCHANGER HAVING CROSSLINKED FLUID PLUGS

(71) Applicant: Halliburton Energy Services, Inc., Houston, TX (US)

(72) Inventors: Bryan John Lewis, Duncan, OK (US); Stanley V. Stephenson, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 128 days.

(21) Appl. No.: 15/145,027

(22) Filed: May 3, 2016

(65) Prior Publication Data

US 2017/0321521 A1 Nov. 9, 2017

(51) Int. Cl.

| | |
|---|---|
| ***E21B 43/267*** | (2006.01) |
| ***E21B 43/26*** | (2006.01) |
| ***E21B 21/06*** | (2006.01) |

(52) U.S. Cl.

CPC ..... *E21B 43/267* (2013.01); *E21B 21/06* (2013.01); *E21B 21/062* (2013.01); *E21B 43/26* (2013.01)

(58) Field of Classification Search

CPC ..... E21B 43/26; E21B 21/06; E21B 43/267; E21B 21/062

See application file for complete search history.

(56) References Cited

U.S. PATENT DOCUMENTS

| | | | |
|---|---|---|---|
| 3,431,747 | A | 3/1969 | Hashemi et al. |
| 3,650,628 | A | 3/1972 | Tawfik et al. |
| 3,662,652 | A | 5/1972 | Cole |
| 3,967,542 | A | 7/1976 | Hall et al. |
| 6,540,487 | B2 | 4/2003 | Polizos et al. |
| 7,201,557 | B2 | 4/2007 | Stover |
| 7,306,437 | B2 | 12/2007 | Hauge |
| 7,713,033 | B2 | 5/2010 | Roach |
| 7,799,221 | B1 | 9/2010 | MacHarg |
| 7,815,421 | B2 | 10/2010 | Bross et al. |
| 7,997,853 | B2 | 8/2011 | Pique et al. |
| 9,091,164 | B2 | 7/2015 | Surjaatmadja et al. |
| 2005/0028979 | A1* | 2/2005 | Brannon ..... C09K 8/62 166/280.2 |

(Continued)

OTHER PUBLICATIONS

Cao, Zheng, et al. "Integration of CFD and RTD analysis in flow pattern and mixing behavior of rotary pressure exchanger with extended angle." Desalination and Water Treatment (2015): 1-11.

(Continued)

*Primary Examiner* — David J Bagnell
*Assistant Examiner* — Tara E Schimpf
(74) *Attorney, Agent, or Firm* — McGuireWoods LLP

(57) ABSTRACT

A method includes introducing a proppant slurry into a first end of a hydraulic energy transfer system, introducing a clean fluid into a second end of the hydraulic energy transfer system opposite the first end, operating the hydraulic energy transfer system to retain a portion of the proppant slurry in the hydraulic energy transfer system while transferring pressure of the clean fluid to the proppant slurry, and forming a fluid plug that separates the proppant slurry and the clean fluid, the fluid plug being formed by increasing a viscosity of the portion of the proppant slurry to be higher than a viscosity of the clean fluid and a viscosity of the proppant slurry in the hydraulic energy transfer system.

20 Claims, 15 Drawing Sheets

(56) References Cited

U.S. PATENT DOCUMENTS

| | | | | |
|---|---|---|---|---|
| 2009/0104046 | A1 | 4/2009 | Martin et al. | |
| 2013/0105157 | A1* | 5/2013 | Barmatov | C09K 8/685 166/280.1 |
| 2014/0128655 | A1* | 5/2014 | Arluck | C07C 7/11 585/860 |
| 2014/0374093 | A1* | 12/2014 | Nguyen | E21B 43/267 166/280.1 |
| 2015/0096739 | A1* | 4/2015 | Ghasripoor | E21B 43/16 166/105 |
| 2015/0184492 | A1 | 7/2015 | Ghasripoor et al. | |
| 2015/0184502 | A1* | 7/2015 | Krish | F04F 13/00 166/250.01 |
| 2015/0184678 | A1 | 7/2015 | Arluck et al. | |
| 2015/0292310 | A1 | 10/2015 | Ghasripoor et al. | |
| 2016/0062370 | A1 | 3/2016 | Gaines-Germain et al. | |

OTHER PUBLICATIONS

Yu, Liu, Zhou Yi-Hui, and Bi Ming-Shua. "3D numerical simulation on mixing process in ducts of rotary pressure exchanger." Desalination and Water Treatment 42.1-3 (2012): 269-273.

* cited by examiner

PRESSURE EXCHANGER HAVING CROSSLINKED FLUID PLUGS

BACKGROUND

To produce hydrocarbons (e.g., oil, gas, etc.) from a subterranean formation, wellbores may be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore.

Generally, after a wellbore has been drilled to a desired depth, completion operations are performed, which may include inserting a liner or casing into the wellbore and, at times, cementing the casing or liner into place. Once the wellbore is completed as desired (lined, cased, open hole, or any other known completion), a stimulation operation may be performed to enhance hydrocarbon production from the wellbore. Examples of some common stimulation operations involve hydraulic fracturing, acidizing, fracture acidizing, and hydrajetting. Hydraulic fracturing, for instance, entails injecting a fluid under pressure into a subterranean formation to generate a network of cracks and fractures, and simultaneously depositing a proppant (e.g., sand, ceramics) in the resulting fractures. The proppant prevents the fractures from closing and enhances the conductivity of the formation, thereby increasing the production of oil and gas from the formation.

A pressure exchanger is sometimes used to increase the pressure of a low-pressure proppant slurry by interacting the low-pressure proppant slurry with a high-pressure clean fluid. However, the clean fluid and the proppant slurry often mix with each other in the pressure exchanger during operation, which reduces the amount of high-pressure proppant slurry that can be output from the pressure exchanger. Further, due to mixing, only a small portion of the stroke length of the channels of the pressure exchanger can be utilized during operation.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
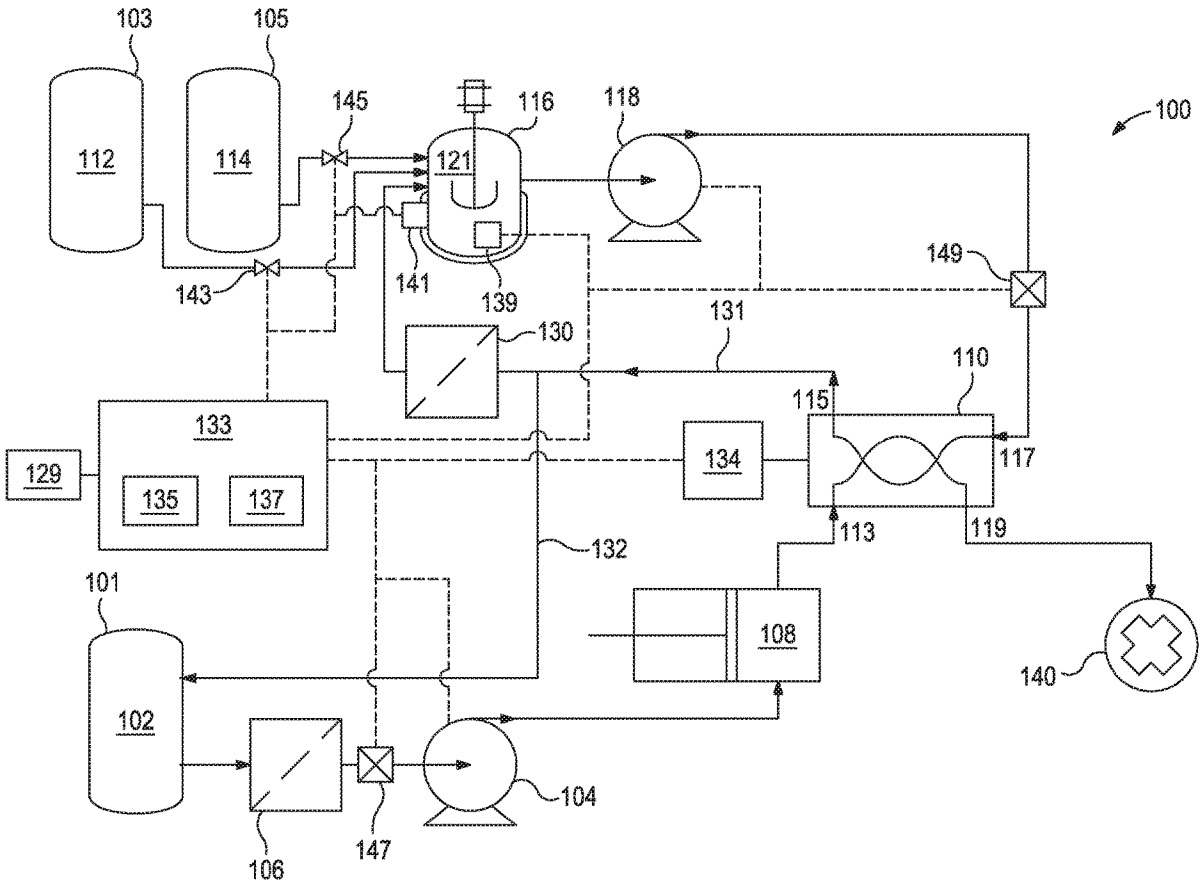
FIG. 1 is a schematic diagram of a fracturing fluid handling system that can incorporate the principles of the present disclosure FIG. 2 schematically illustrates a channel or vessel of an hydraulic energy transfer system containing a fluid plug interposing clean fluid and proppant slurry.

The present disclosure relates generally to systems and methods for injecting a proppant slurry into a wellbore and, more particularly, to a pressure exchanger configuration that pressurizes the proppant slurry and minimizes mixing of a clean fluid and the proppant slurry. While the disclosed examples are discussed in terms of minimizing mixing between a clean fluid and proppant slurry for use in an oil and/or gas well, the same principles and concepts may be equally employed to minimize mixing between any two fluids. These fluids may be multi-phase fluids such as gas/liquid flows, gas/solid particulate flows, liquid/solid particulate flows, gas/liquid/solid particulate flows, or any other multi-phase flow. Moreover, these fluids may be non-Newtonian fluids (e.g., shear thinning fluid), highly viscous fluids, non-Newtonian fluids containing proppant, or highly viscous fluids containing proppant.

As used herein, the term "proppant" or variations thereof refers to a mixture of one of more granular solids such as sized sand, resin-coated sand, sintered bauxite beads, metal beads or balls, ceramic particles, glass beads, polymer resin beads, or bio-degradable materials such ground nut shells, and the like. In certain examples, the proportion of proppant may be in the range of 5-90%, as designed by the user of the process.

As used herein, the phrase "proppant slurry" or variations thereof refers to a proppant-carrying fluid that is a mixture of a granular solid, such as sand, with desired fluid additives. The proppant slurry may be any mixture capable of suspending and transporting proppant in desired concentrations. For example, the proppant slurry may contain above about 25 pounds of proppant per gallon of proppant slurry. In other examples, the proppant slurry may contain up to 27 pounds of granular solid per gallon of fluid. In certain examples, the fluid additives in the proppant slurry may include viscosity modifiers, acids (e.g., acetic acid, hydrochloric acid, citric acid), salts (e.g., sodium chloride, borate salts), fluid loss control additives, clay stabilizers, surfactants, oxygen scavengers, alcohols, breakers, bactericides, and non-emulsifying agents, thickeners, etc.

In certain examples, the proppant slurry may comprise fluid additives such as a gelling agent that may comprise substantially any of the viscosifying compounds known to function in the desired manner. The gelling agent can comprise, for example, substantially any polysaccharide polymer viscosifying agent such as guar gum, derivatized guars such as hydroxypropyl guar, derivatized cellulosics such as hydroxyethylcellulose, derivatives of starch, polyvinyl alcohols, acrylarnides, xanthan gums, and the like. A specific example of a suitable gelling agent is guar, hydroxypropylguar (HPG), carboxymethylhydroxyethylcellulose (CMHEC), or carboxymethylhydroxypropylguar (CMHPG) present in an amount of from about 0.2 to about 0.75 weight percent in the fluid.

In certain examples, the proppant slurry may also comprise fluid additives such as a crosslinking agent to further increase the viscosity of the proppant slurry by crosslinking the gelling agents in the proppant slurry. For instance, crosslinking agents may include chromium and other transition metal ions, Acrylamide-containing polymers, copolymers, and partially hydrolyzed variants thereof, polyethyleneimine, polyvinylamine, any derivative thereof, any salt thereof, and any combination thereof, organic titanium monomers or polymers, organotitanate chelates such as titanium ammonium lactate or titanium triethanolamine, borate sources such as boric acid, borax, or alkaline earth metal borates, alkali metal alkaline, earth metal borates and mixtures thereof.

Generally, it is desirable to control the time required for the proppant slurry to attain the desired viscosity, referred to herein as the "gel-time." The gel-time can be controlled by controlling the rate of crosslinking the gelling agents in the proppant slurry, which may be adjusted (increased or decreased) based on the rate of dissolution of the crosslinking agents, the concentration of the crosslinking agents, the pH level of the gelling agents, or a combination thereof. In addition, instant crosslinkers, and surfactants may be added to the proppant slurry to reduce the gel-time thereof.

As used herein, the phrase "clean fluid," or variations thereof, refers to a fluid that does not have significant amounts of proppant or other solid materials suspended therein. Clean fluids may include most brines and may also include fresh water. The brines may sometimes contain viscosifying agents or friction reducers. The clean fluid may also comprise an energized fluids such as foamed or comingled brines with carbon dioxide or nitrogen, acid mixtures or oil-based fluids and emulsion fluids.

As used herein, the phrase "fracturing fluid" or variations thereof, refers to a mixture of a clean fluid and a proppant or proppant slurry in any proportion.

As used herein, the term "fluid plug" or variations thereof refers to any non-solid, fluidic substance that is capable of isolating two or more fluids to minimize mixing or intermingling therebetween. The fluid plug may also refer to a non-solid, fluidic interface that isolates two or more fluids from each other. The fluid plug may be made of a gas, a liquid, or a combination thereof. In other examples, the fluid plug may be made of a multi-phase fluid such as a gas/liquid flow, a gas/solid particulate flow, a liquid/solid particulate flow, a gas/liquid/solid particulate flow, or any other multiphase flow. In still other examples, the fluid plug may include non-Newtonian fluids (e.g., shear thinning fluid), highly viscous fluids, non-Newtonian fluids containing proppant, or highly viscous fluids containing proppant.

FIG. 1 is a schematic diagram of a fracturing fluid handling system 100 (hereinafter referred to as the "frac system 100") that can incorporate the principles of the present disclosure. The frac system 100 may be used to help hydraulically fracture a well in low-permeability reservoirs, among other wellbore servicing jobs. In hydraulic fracturing operations, a wellbore servicing fluid, such as the proppant slurry, is pumped at high-pressure downhole into a wellbore. In this example, the frac system 100 introduces the proppant slurry into a desired portion of a subterranean hydrocarbon formation at a sufficient pressure and velocity to cut a casing, create perforation tunnels, and/or form and extend a network of fractures within the subterranean hydrocarbon formation. The proppant slurry keeps the fractures open so that hydrocarbons may flow from the subterranean hydrocarbon formation into the wellbore. This hydraulic fracturing creates high-conductivity fluid communication between the wellbore and the subterranean hydrocarbon formation.

As illustrated, a clean fluid 102 derived from a source 101 (e.g., a storage tank) may be fed to a booster pump 104. Prior to entering the booster pump 104, the clean fluid 102 may pass through one or more filters 106. The clean fluid 102 may be a substantially proppant free fluid and may include potable water, non-potable water, untreated water, treated water, a hydrocarbon-based fluid or other fluids. The filter 106 may be any filter suitable for removing undesirable substances from the clean fluid 102 to maintain a desirable performance of the frac system 100. The booster pump 104 may be used to vary the flow rate and/or the pressure of the clean fluid 102 and increase the fluid pressure to an intermediate pressure prior to conveying the clean fluid 102 to a high-pressure pump 108. The high-pressure pump 108 may increase the pressure of the clean fluid 102 from the intermediate pressure to around 5,000 kPa to 25,000 kPa, 20,000 kPa to 50,000 kPa, 40,000 kPa to 75,000 kPa, 75,000 kPa to 100,000 kPa or greater. The high-pressure (HP) clean fluid 102 is then provided to a high-pressure (HP) inlet 113 of one or more hydraulic energy transfer systems 110 (one shown).

The frac system 100 also includes a blender 116 for mixing fluid additives 112 and proppant 114 (each obtained from respective sources 103, 105) to achieve a well-blended proppant slurry 121. The mixing conditions of the blender 116, including time period, agitation method, pressure, and temperature of the blender 116, may be chosen by one of ordinary skill in the art with the aid of this disclosure to produce a homogeneous blend having a desirable composition, density, and viscosity. In alternative examples, however, sand (or another proppant), water, and additives may be premixed and/or stored in a storage tank for use in the frac system 100. The proppant slurry 121 is supplied to a booster pump 118 for varying the flow rate and/or the pressure of the proppant slurry 121 provided to the hydraulic energy transfer system 110 via a low-pressure (LP) inlet 117. Accordingly, the HP clean fluid 102 and the LP proppant slurry 121 (including the fluid additives 112 and the proppant 114) are provided to the hydraulic energy transfer system 110 via two separate flow paths, and the HP clean fluid 102 and the LP proppant slurry 121 do not mix prior to being fed to the hydraulic energy transfer system 110. The hydraulic energy transfer system 110 may be made from materials resistant to corrosive and abrasive substances in the clean fluid 102 and/or the proppant slurry 121. For example, the hydraulic energy transfer system 110 may be made out of ceramics (e.g., alumina, cermets, such as carbide, oxide, nitride, or boride hard phases) within a metal matrix (e.g., Co, Cr or Ni or any combination thereof) such as tungsten carbide in a matrix of CoCr, Ni, NiCr or Co.

The hydraulic energy transfer system 110 is configured to transfer pressure and/or work between the HP clean fluid 102 and the LP proppant slurry 121. During operation, as described in further detail below, the clean fluid 102 transfers a portion of its pressure to the proppant slurry 121 and a LP clean fluid 102 exits the hydraulic energy transfer system 110 via a low-pressure outlet 115. As a result, the proppant slurry 121 exits the hydraulic energy transfer system 110 at an increased pressure via a high-pressure outlet 119. The HP proppant slurry 121 may then be used for various wellbore operations. In some embodiments, for instance, the HP proppant slurry 121 may be injected into a subterranean formation via a wellhead installation 140 for performing hydraulic fracturing operations.

The hydraulic energy transfer system 110 may be operated using a drive 134 such as an electric motor, a combustion engine, a hydraulic motor, a pneumatic motor, or a combination thereof. Depending on the type of hydraulic energy transfer system 110, the drive 134 may be either a rotary drive or a reciprocating drive. As described below, in operation, the drive 134 may control the flow of clean fluid 102 and the proppant slurry 121 through the hydraulic energy transfer system 110. The drive 134 may facilitate startup with highly viscous or particulate laden proppant slurry 121 fluids, which enables a rapid start of the hydraulic energy transfer system 110. The drive 134 may also provide additional force that enables the hydraulic energy transfer system 110 to operate with highly viscous/particulate laden proppant slurry 121. However, in some embodiments and as explained below, the drive 134 may be absent and the hydraulic energy transfer system 110 may be operated by controlling the velocity of the fluids (clean fluid 102 and the proppant slurry 121) entering the hydraulic energy transfer system 110 and the flow angle of the fluids.

A pre-determined or metered amount of the LP clean fluid 102 may be returned to the blender 116 via a flow path 131 to be mixed with the proppant slurry 121. In some cases, the LP clean fluid 102 may be contaminated with an unknown amount of proppant slurry 121 due to contact with the proppant slurry 121 in the hydraulic energy transfer system 110. In order to maintain the concentration of the proppant slurry 121 in the blender at a known level, the contaminated LP clean fluid 102 may be first provided to a filtration or separation system 130 that removes any residual proppant before the clean fluid 102 is injected into the blender 116. For example, the filtration or separation system 130 may include one or more different types of filters, including cartridge filters, slow sand filters, rapid sand filters, pressure filters, bag filters, membrane filters, granular micro media filters, backwashable strainers, backwashable sand filters, hydrocyclones, and so forth. The remaining LP clean fluid 102 may be returned to the source 101 via flow path 132 for recirculation.

In order to control the composition (e.g., the percentages of fluid additives, clean fluid, and proppant), pressure, and flow of the clean fluid 102 and proppant slurry 121, the frac system 100 may include a controller 133. The controller 133 may be configured to maintain flow, composition, and pressure of the clean fluid 102 and the proppant slurry 121 within threshold ranges, above a threshold level, and/or below a threshold level. The controller 133 may include one or more processors 135 and one or more memory devices 137 (one of each shown) storing computer readable program code for controlling the operation of the various components of the frac system 100. The memory device 137 may include a non-transitory medium such as random access memory (RAM) devices, read only memory (ROM) devices, and the like. The controller 133 may also be communicably coupled to one or more external non-volatile memory devices such as optical storage devices (e.g., CD or DVD), semiconductor memory devices (e.g., EPROM, EEPROM, flash memory devices), magnetic disks (e.g., internal hard disks, removable disks, and others), and the like. The controller 133 may be communicably coupled to one or more input/output devices 129 such as, a keyboard, a printer, a display device, a pointing device (e.g., a mouse, a trackball, a tablet, a touch sensitive screen, etc.), a mobile computing device, a mobile communication device, and the like, to exchange data and provide interaction with a user.

The controller 133 may receive feedback from a sensor 139 in the blender 116 regarding the chemical composition of the proppant slurry 121. For instance, the chemical composition may indicate the concentration of gelling agents in the proppant slurry 121. The controller 133 may determine whether the concentration of the gelling agents is sufficient for the proppant slurry 121 to achieve the desired viscosity within a desired gel-time. The controller 133 may, accordingly, open or close valves 143 and/or 145 to adjust the amount of fluid additives 112 and/or proppant 114, respectively, entering the blender 116. The controller 133 may also monitor the level of the proppant slurry 121 in the blender 116 with the level sensor 141. If the level of the proppant slurry 121 in the blender 116 is incorrect, the controller 133 may open and close valves 143 and/or 145 to increase or decrease the flow of fluid additives 112 and/or proppant 114 into the blender 116.

In other examples, the controller 133 may receive a signal from a flow meter 147 regarding the flow rate of the clean fluid 102 flowing into the booster pump 104. In response to the measurements obtained by the flow meter, 147, the controller 133 may increase or decrease the speed of the booster pump 104 to change the flow rate of the clean fluid 102. Another flow meter 149 may be arranged to monitor the flow rate of the proppant slurry 121 to the hydraulic energy transfer system 110 and provide a signal to the controller 133 indicating the flow rate. If the flow rate of the proppant slurry 121 surpasses a predetermined upper or lower flow rate limit, the controller 133 may increase or decrease the speed of the booster pump 118 to bring the flow rate of the proppant slurry 121 back within desired operational limits. The controller 133 may also be configured for controlling the operation of the hydraulic energy transfer system 110. In some examples, the controller 133 may control the drive 134 to adjust a rotational speed of a rotor of the hydraulic energy transfer system 110, or to adjust the timing of opening and closing (also referred to as the valve timing) of one or more valves of the hydraulic energy transfer system 110. The controller 133 may also control the operation of the hydraulic energy transfer system 110 by actuating one or more check valves thereof.

Figure 2:
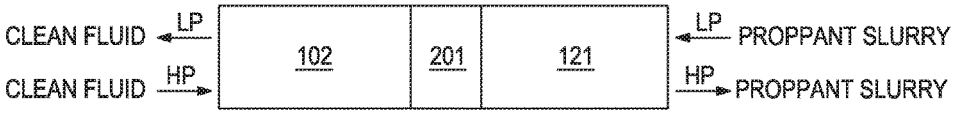

According to embodiments of the present disclosure, in order to minimize mixing of the clean fluid 102 and the proppant slurry 121 during the pressure exchange operation, a fluid plug may be created during operation to separate the clean fluid 102 and the proppant slurry 121 within the hydraulic energy transfer system 110. FIG. 2 schematically illustrates an example channel or vessel of the hydraulic energy transfer system 110 that contains a volume of the clean fluid 102 and a volume of the proppant slurry 121. The hydraulic energy transfer system 110 may be operated such that a portion of the proppant slurry 121 always remains in the channels (or vessels) of the hydraulic energy transfer system 110. As the hydraulic energy transfer system 110 operates, gelling agents included in the proppant slurry 121 may crosslink to increase the viscosity of the proppant slurry 121 and thereby result in the creation of a fluid plug 201. In some embodiments, one or more instant crosslinkers may be added to the proppant slurry 121 to increase the rate of crosslinking (reduce the gel-time) of the proppant slurry 121. For instance, the instant crosslinker may be initially introduced into the proppant slurry 121 during operation of the hydraulic energy transfer system 110 to accelerate the creation of the fluid plug 201. After a desired amount of proppant slurry 121 with the instant crosslinker has been introduced into the hydraulic energy transfer system 110, the addition of the instant crosslinker may be withheld.

The fluid plug 201 exhibits a higher viscosity than the viscosities exhibited by the proppant slurry 121 and the clean fluid 102. Due to its higher viscosity and interposition between the proppant slurry 121 and the clean fluid 102, the fluid plug 201 prevents or substantially mitigates mixing of the proppant slurry 121 and the clean fluid 102 in the hydraulic energy transfer system 110.

Figure 3:
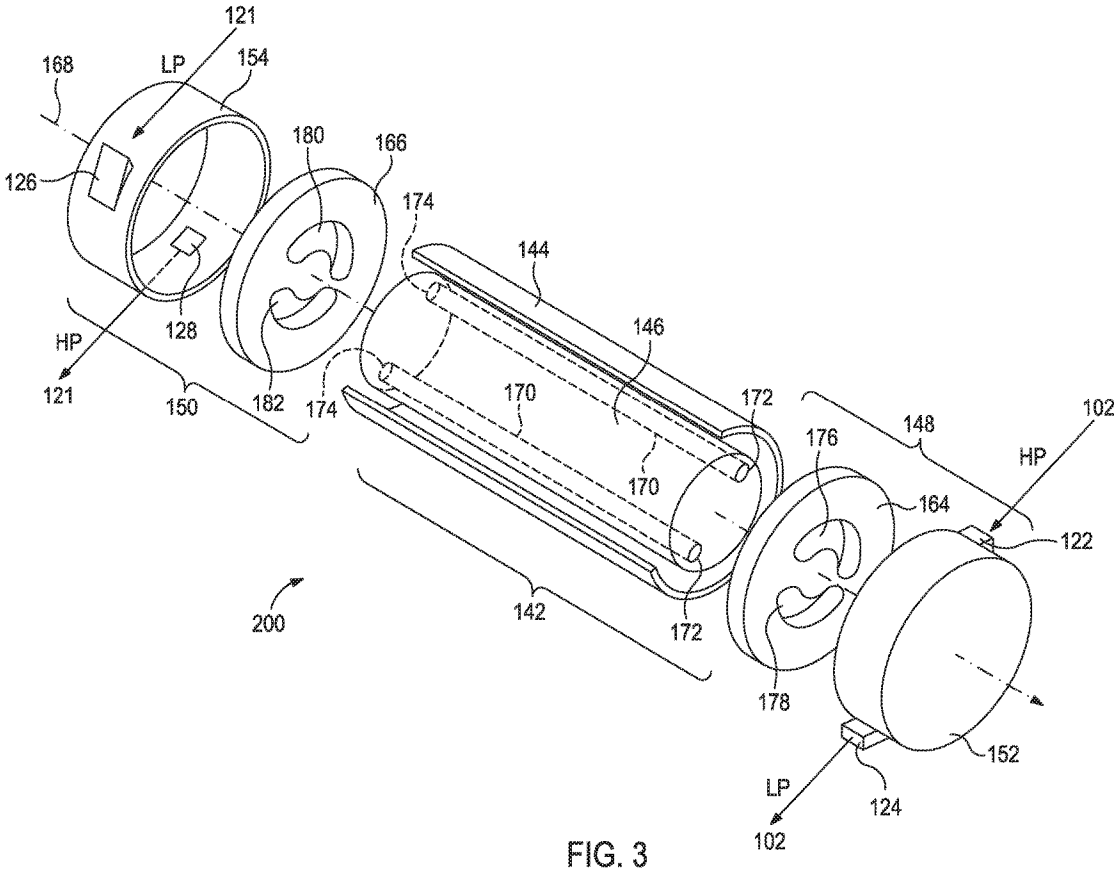
FIG. 3 is an exploded perspective view of an example rotary isobaric pressure exchanger (rotary IPX).

FIG. 3 is an exploded perspective view of an example rotary isobaric pressure exchanger (rotary IPX) 200. The rotary IPX 200 may be used as the hydraulic energy transfer system 110 in FIG. 1. Although the following example is described in terms of the rotary IPX 200, other kinds of pressure exchangers may also be used as the hydraulic energy transfer system 110, without departing from the scope of the disclosure. The rotary IPX 200 is configured to transfer pressure and/or work between the clean fluid 102 and the proppant slurry 121.

As illustrated, the rotary IPX 200 may include a generally cylindrical body portion 142 that includes a sleeve 144 (e.g., rotor sleeve) and a rotor 146 positioned within the sleeve 144. The rotary IPX 200 may also include two end caps 148 and 150 that include manifolds 152 and 154, respectively. The manifold 152 includes respective inlet and outlet ports 122 and 124, while the manifold 154 includes respective inlet and outlet ports 126 and 128. In operation, the inlet ports 122, 126 enabling the clean fluid 102 and the proppant slurry 121 to enter the rotary IPX 200 to exchange pressure, while the outlet ports 124, 128 enable the clean fluid 102 and the slurry to exit the rotary IPX 200.

In operation, the inlet port 122 receives the high-pressure clean fluid 102 and, after exchanging pressure, the outlet port 124 discharges the LP clean fluid 102 out of the rotary IPX 200. Similarly, the inlet port 126 receives the LP proppant slurry 121 and the outlet port 128 discharges the HP proppant slurry 121 out of the rotary IPX 200. The end caps 148 and 150 include respective end covers 164 and 166 disposed within respective manifolds 152 and 154 that enable fluid sealing contact with the rotor 146.

The rotor 146 may be cylindrical and disposed in the sleeve 144, which enables the rotor 146 to rotate about the axis 168. The drive 134 (FIG. 1), which, in this case, is a rotary drive (e.g., a rotary electric motor, a rotary hydraulic motor, a rotary combustion motor, etc.), may be coupled to the rotor 146 via a shaft (not expressly shown) to control rotation thereof. However, in some embodiments and as mentioned above, the drive 134 may be absent. The rotational speed of the rotary IPX 200 may be controlled by controlling the velocity of the fluids (clean fluid 102 and the proppant slurry 121) entering the rotor 146 (FIG. 1) and the flow angle of the fluids. The fluid velocity is determined by the flow rate of the fluids and the cross-sectional area of the fluid flow paths. The design of the end covers 164, 166 and the inlet and outlet apertures 176, 178, 180, and 182 therein determine the flow angle of the fluids entering the channels 170.

The rotor 146 may have a plurality of channels 170 (two shown) extending substantially longitudinally through the rotor 146 with openings 172 and 174 at each end arranged symmetrically about the longitudinal axis 168. In some embodiments, the channels 170 may exhibit a circular cross-sectional shape, but could alternatively exhibit other cross-sectional shapes, such as polygonal (e.g., square, rectangular, etc.). The openings 172 and 174 of the rotor 146 are arranged for hydraulic communication with inlet and outlet apertures 176 and 178, and 180 and 182 in the end covers 164 and 166, respectively, in such a manner that during rotation the channels 170 are exposed to fluid at high-pressure and fluid at low-pressure. As illustrated, the inlet and outlet apertures 176 and 178, and 180 and 182 may be designed in the form of arcs or segments of a circle (e.g., C-shaped).

FIGS. 4-7 are progressive views of the rotary IPX 200 during a balanced-displacement mode of operation and illustrating the sequence of positions of a single channel 170 as the rotor 146 rotates through a complete cycle of the rotary IPX 200. It is noted that FIGS. 4-7 depict a simplification of the rotary IPX 200 and show only one channel 170 for purposes of illustrating example operation, and other examples of the rotary IPX 200 may have configurations different from that shown in FIGS. 4-7. As described in detail below, in the balanced-displacement mode of operation, the rotary IPX 200 facilitates pressure exchange between the clean fluid 102 (FIG. 1) and the proppant slurry 121 (FIG. 1) by enabling the clean fluid 102 and the proppant slurry 121 to come into contact with each other within the rotor 146 and, more particularly, within the channel 170.

Figure 4:
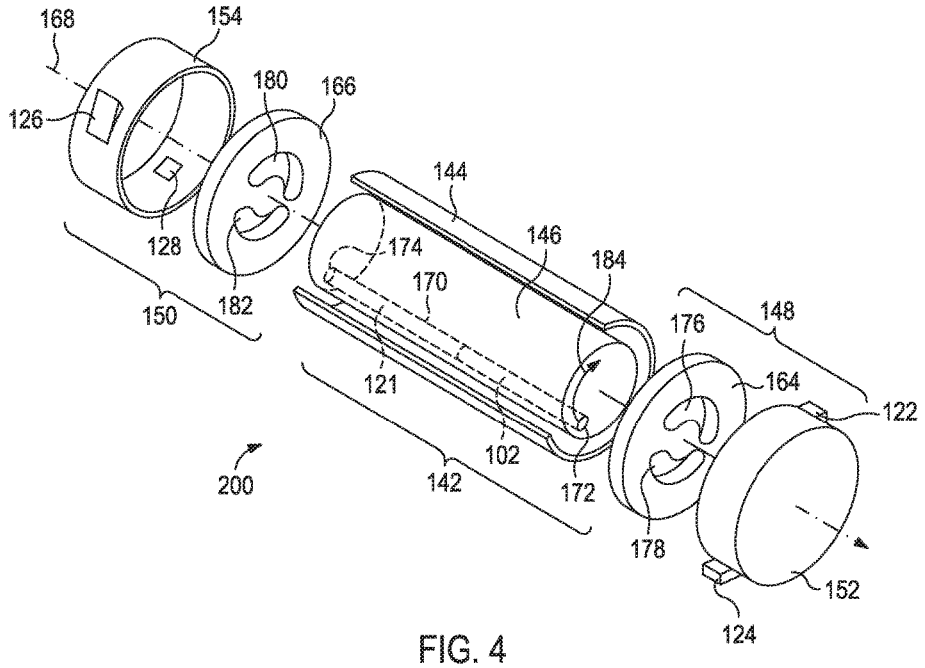
FIG. 4 is an exploded perspective view of the rotary IPX of FIG. 3 in a first operating position in a balanced-displacement mode of operation.

In FIG. 4, the channel opening 172 is shown in a first angular position. In the first angular position, the channel opening 172 is in fluid communication with the aperture 178 in end cover 164 and therefore with the manifold 152, while the opposing opening 174 is in hydraulic communication with the aperture 182 in the end cover 166 and, by extension, with the manifold 154. The rotor 146 may rotate in the clockwise direction, as indicated by arrow 184. In operation, LP proppant slurry 121 in the channel 170 passes through the end cover 166 and enters the channel 170 where it contacts the clean fluid 102 also disposed in the channel 170. The proppant slurry 121 then drives the clean fluid 102 out of the channel 170, through the end cover 164, and out of the rotary IPX 200.

Figure 5:
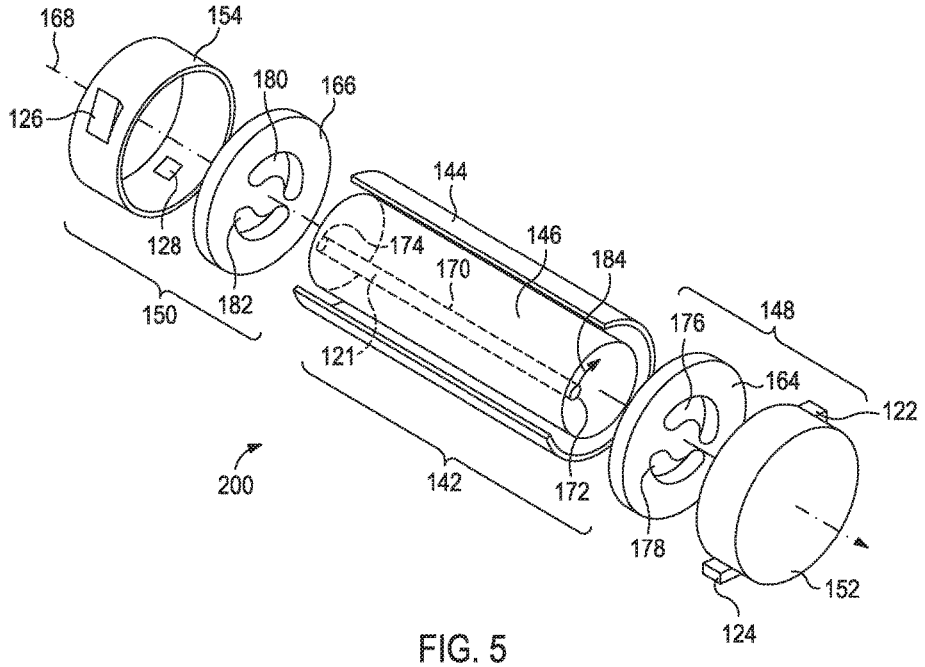
FIG. 5 is an exploded perspective view of the rotary IPX of FIG. 3 in a second operating position in the balanced-displacement mode of operation.

In FIG. 5, the channel 170 has rotated clockwise through an arc of approximately 90 degrees to a second angular position. In this position, the opening 174 is no longer in fluid communication with the apertures 180 and 182 of the end cover 166, and the opening 172 is no longer in fluid communication with the apertures 176 and 178 of the end cover 164. Accordingly, the LP proppant slurry 121 is temporarily contained within the channel 170.

Figure 6:
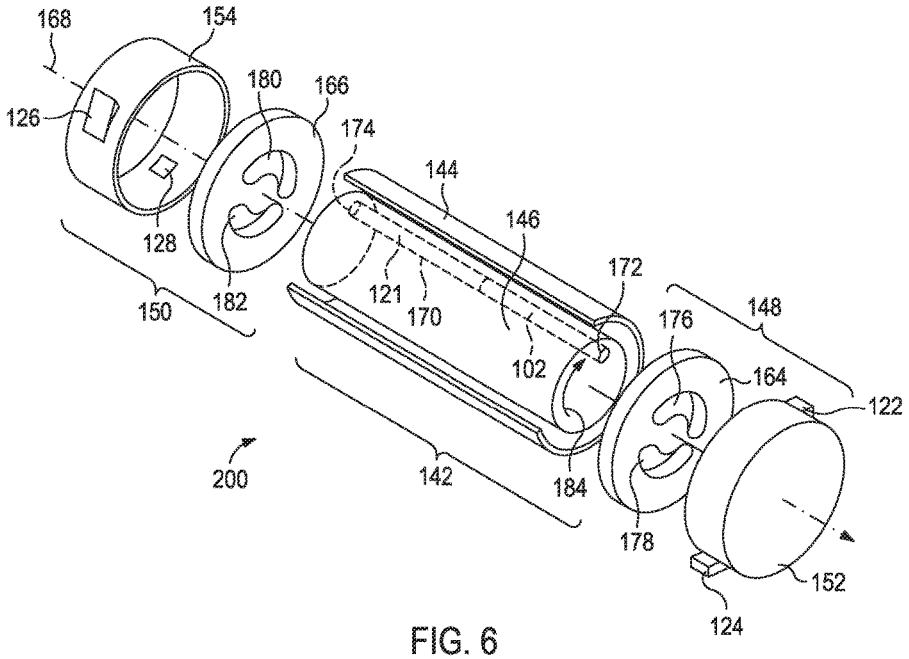
FIG. 6 is an exploded perspective view of the rotary IPX of FIG. 3 in a third operating position in the balanced-displacement mode of operation.

In FIG. 6, the channel 170 has rotated through approximately 180 degrees of arc from the first position of FIG. 4 and to a third angular position. The opening 174 is now in fluid communication with the aperture 180 in the end cover 166, and the opening 172 of the channel 170 is now in fluid communication with the aperture 176 of the end cover 164. In this position, high-pressure clean fluid 102 enters the channel 170 and contacts the LP proppant slurry 121 also in the channel 170. The high-pressure clean fluid 102 operates to pressurize the LP proppant slurry 121 and thereby drive all the pressurized proppant slurry 121 out of the fluid channel 170 and through the aperture 180 for use in the frac system 100 (FIG. 1).

Figure 7:
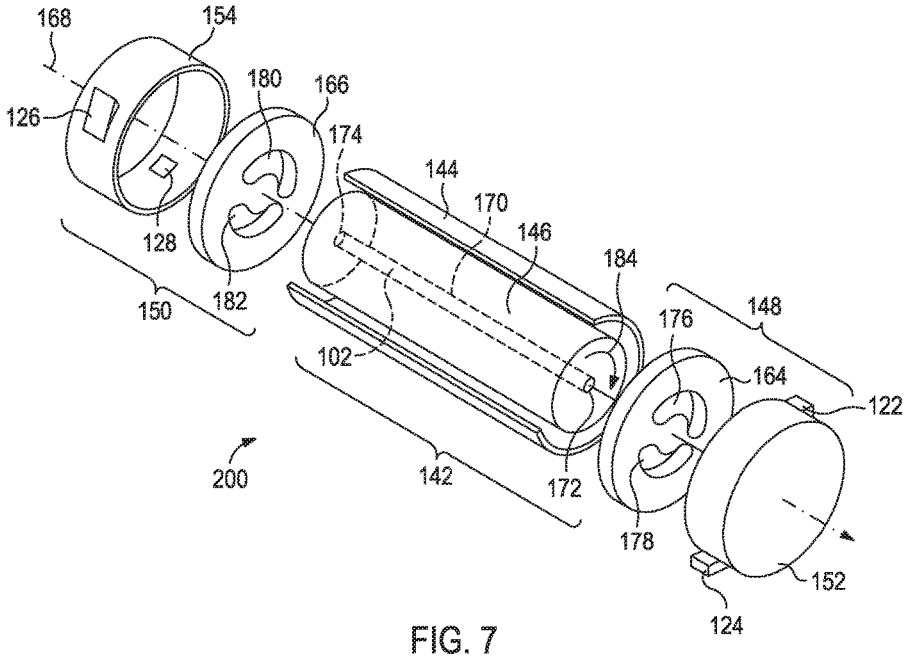
FIG. 7 is an exploded perspective view of the rotary IPX of FIG. 3 in a fourth operating position in the balanced-displacement mode of operation.

In FIG. 7, the channel 170 has rotated through approximately 270 degrees of arc from the first position of FIG. 4 and to a fourth angular position. In this position, the opening 174 is no longer in fluid communication with the apertures 180 and 182 of end cover 166, and the opening 172 is no longer in fluid communication with the apertures 176 and 178 of end cover 164. Accordingly, the clean fluid 102 is no longer pressurized and is temporarily contained within the channel 170 until the rotor 146 rotates to start the cycle over again.

Due to the absence of a fluid separator, the clean fluid 102 and the proppant slurry 121 tend to mix with each other in the channel 170. As a result, only a portion (around 25%) of the stroke length of the channels 170 can effectively be used for pressure exchange, which reduces the volumetric efficiency of the rotary IPX 200. This inefficiency can be overcome by introducing a fluid plug (e.g., the fluid plug 201 of FIG. 2) in each channel 170 to separate the clean fluid 102 and the proppant slurry 121 and operating the rotary IPX 200 in an under-displacement mode.

FIGS. 8-12 are exploded-progressive views of the rotary IPX 200 illustrating the sequence of positions of a single channel 170 as the rotor 146 rotates during an under-displacement mode of operation. In some embodiments, the operation of the rotary IPX 200 leading up to FIG. 8 may be similar to the operation illustrated in FIGS. 4-6 and may be best understood with reference thereto.

Figure 8:
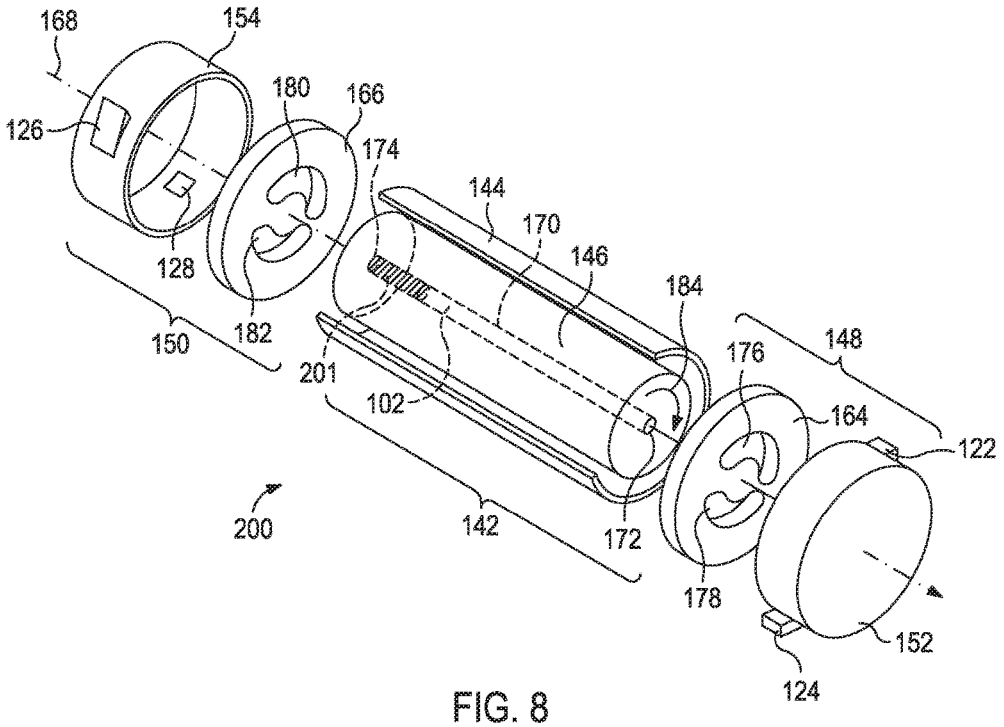
FIGS. 8-12 are exploded-progressive views of the rotary IPX of FIG. 3 during an under-displacement mode of operation and illustrate the sequence of positions of the channel of the rotary IPX.

Referring to FIG. 8, in the under-displacement mode of operation, the rotational speed of the rotor 146 is controlled and otherwise optimized such that the channel 170 rotates through approximately 270 degrees of arc from the first angular position of FIG. 4 and to a fourth angular position to sufficiently occlude the opening 174 against the cover 166 before all the pressurized proppant slurry 121 has been driven out of the channel 170. Upon being occluded, the opening 174 is no longer in fluid communication with the apertures 180 and 182 of the end cover 166, and the opening 172 is no longer in fluid communication with the apertures 176 and 178 of the end cover 164. A portion of the proppant slurry 121 is thus retained in the channel 170 and forms the fluid plug 201. In an example, the rotational speed is controlled such that an amount of the proppant slurry 121 sufficient to obtain a fluid plug (see below) having an axial extent between about 5% to about 25% of the length of the channel 170 is retained in the channel 170.

Figure 9:
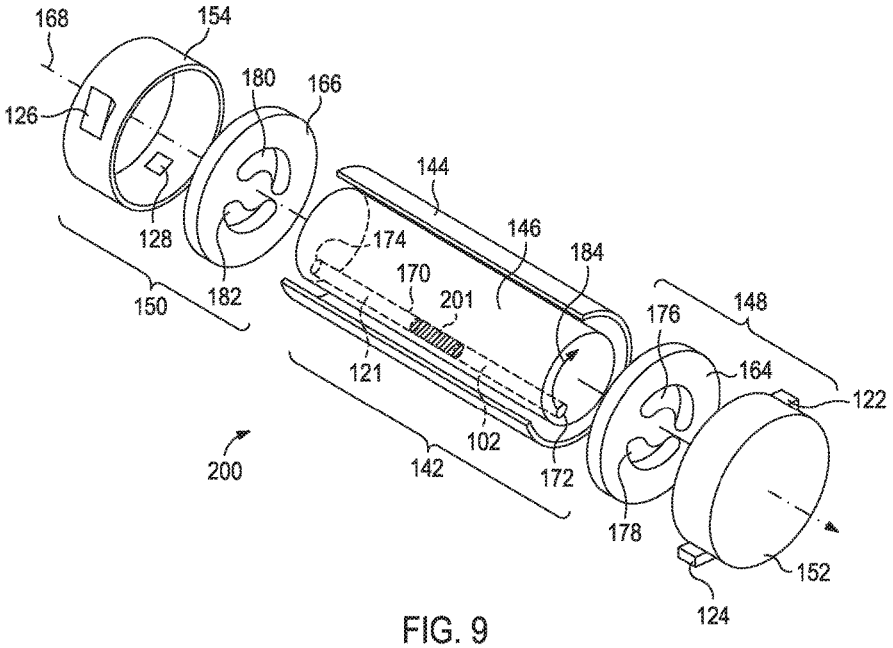

In FIG. 9, the channel 170 containing the fluid plug 201 rotates through an arc of approximately 90 degrees from the fourth position and to the first angular position (FIG. 4), wherein the opening 174 is in fluid communication with the aperture 182. The LP proppant slurry 121 enters the channel 170, where it contacts the fluid plug 201. The clean fluid 102 is driven out of the channel 170, through the end cover 164, and out of the rotary IPX 200. The rotational speed of the rotor 146 is controlled and otherwise optimized such that the channel 170 rotates sufficiently to occlude the opening 172 against the cover 164 after all the clean fluid 102 has been driven out of the channel 170 and before the fluid plug 201 can be driven out of the channel 170. However, in some examples, not all the clean fluid 102 may exit the channel 170 and a portion thereof may be retained in the channel 170.

Figure 10:
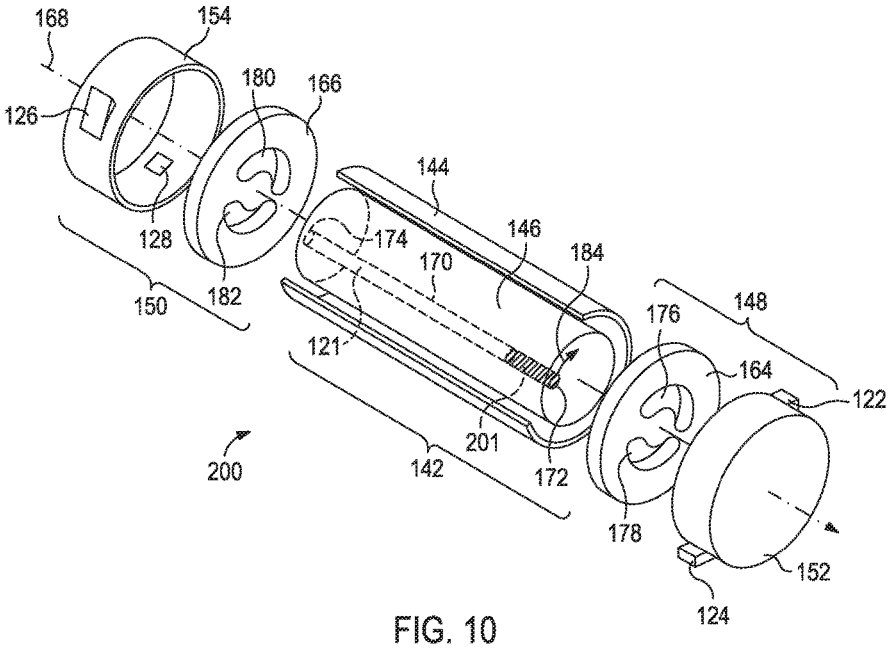

In FIG. 10, the channel 170 has rotated clockwise to the second position, wherein the opening 174 is no longer in fluid communication with the apertures 180 and 182 of the end cover 166, and the opening 172 is no longer in fluid communication with the apertures 176 and 178 of the end cover 164. As illustrated, the LP proppant slurry 121 and the fluid plug 201 are contained within the channel 170. Some of the clean fluid 102 may also be contained within the channel 170, if applicable.

Figure 11:
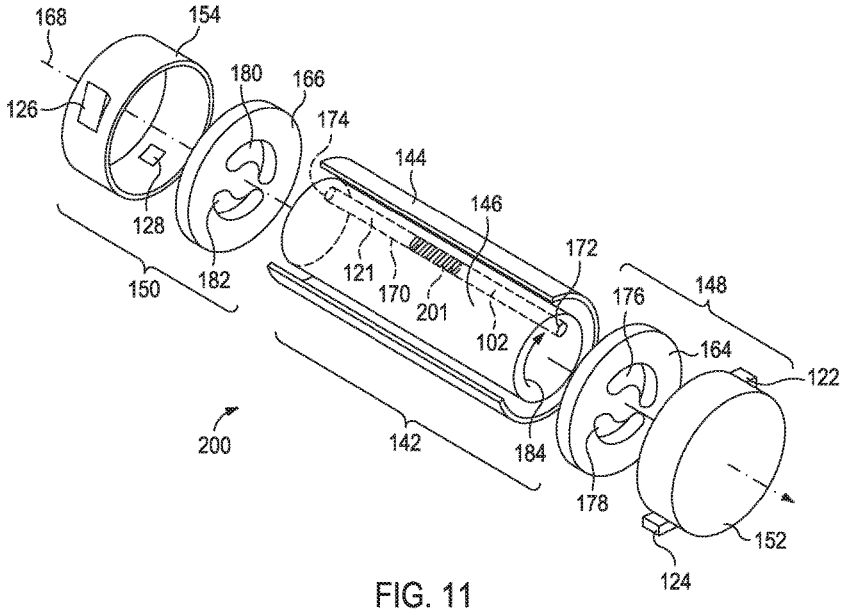

In FIG. 11, the channel 170 has rotated to the third position, wherein the opening 174 is in fluid communication with aperture 180 in end cover 166 and the opening 172 is in fluid communication with aperture 176 of the end cover 164. In this position, high-pressure clean fluid 102 is able to enter the channel 170 and drive out the proppant slurry 121 out of the channel 170 through the aperture 180 for use in the frac system 100 (FIG. 1). However, the rotational speed of the rotor 146 is controlled such that the channel 170 rotates sufficiently to occlude the opening 174 against the cover 166 after the proppant slurry 121 has been driven out of the channel 170 and before the fluid plug 201 is driven out of the channel 170. Upon being occluded, the opening 174 is no longer in fluid communication with the apertures 180 and 182 of the end cover 166 and fluid plug 201 is thereby prevented from exiting the channel 170.

Figure 12:
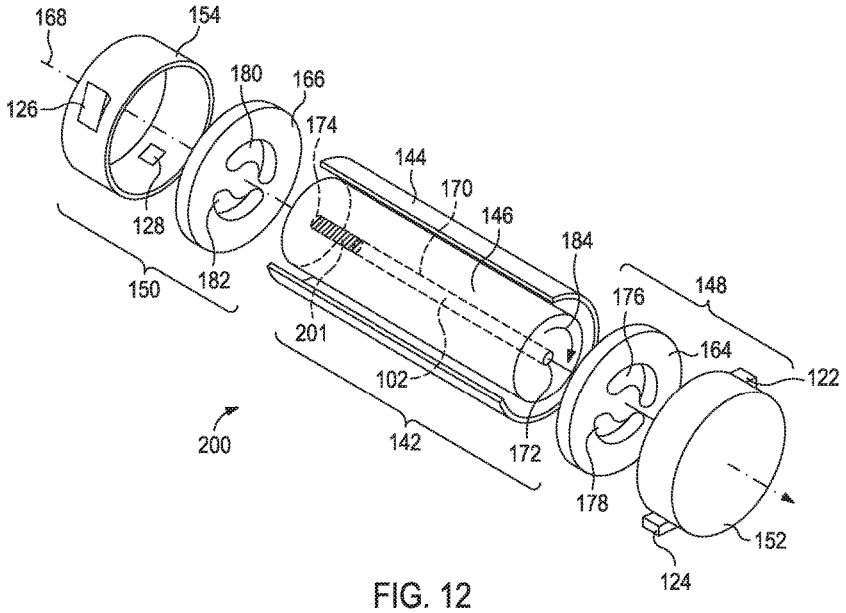

In FIG. 12, the channel 170 has rotated further through approximately 270 degrees from the position in FIG. 9. In this position, the opening 174 is no longer in fluid communication with the apertures 180 and 182 of end cover 166, and the opening 172 is no longer in fluid communication with the apertures 176 and 178 of end cover 164. Accordingly, the fluid plug 201 and the clean fluid 102 are contained within the channel 170 until the rotor 146 rotates again to the first position in FIG. 9, and the process repeats.

As the operation of the rotary IPX 200 progresses, the viscosity of the fluid plug 201 increases based on the gel-time. The fluid plug 201 attains a viscosity higher than the viscosities of the proppant slurry 121 and the clean fluid 102 in the channel 170. Because of the higher viscosity, the fluid plug 201 impedes mixing of the proppant slurry 121 and the clean fluid 102 in the channels 170 during pressure transfer.

The benefits of the fluid plug 201 will be readily apparent to one skilled in the art. For instance, because the fluid plug 201 reduces mixing of the clean fluid 102 and the proppant slurry 121, greater stroke length of the channels 170 can be utilized. As a result, the volumetric efficiency of the rotary IPX 200 increases. In addition, because of its fluidic nature, the fluid plug 201 reduces wear and tear and frictional losses during operation. On occasions, the fluid plug 201 may be discharged from the rotary IPX 200. However, the rotary IPX 200 may continue to operate in the absence of the fluid plug 201. The rotational speed of the rotor 146 and the flow rates of the clean fluid 102 and the proppant slurry 121 can be adjusted to form a new fluid plug without requiring to shut down the operation of the rotary IPX 200. Additionally, because mixing between the clean fluid 102 and the proppant slurry 121 is reduced, the filtration or separation system 130 (FIG. 1) may not be required in the frac system 100 (FIG. 1).

Figure 13:
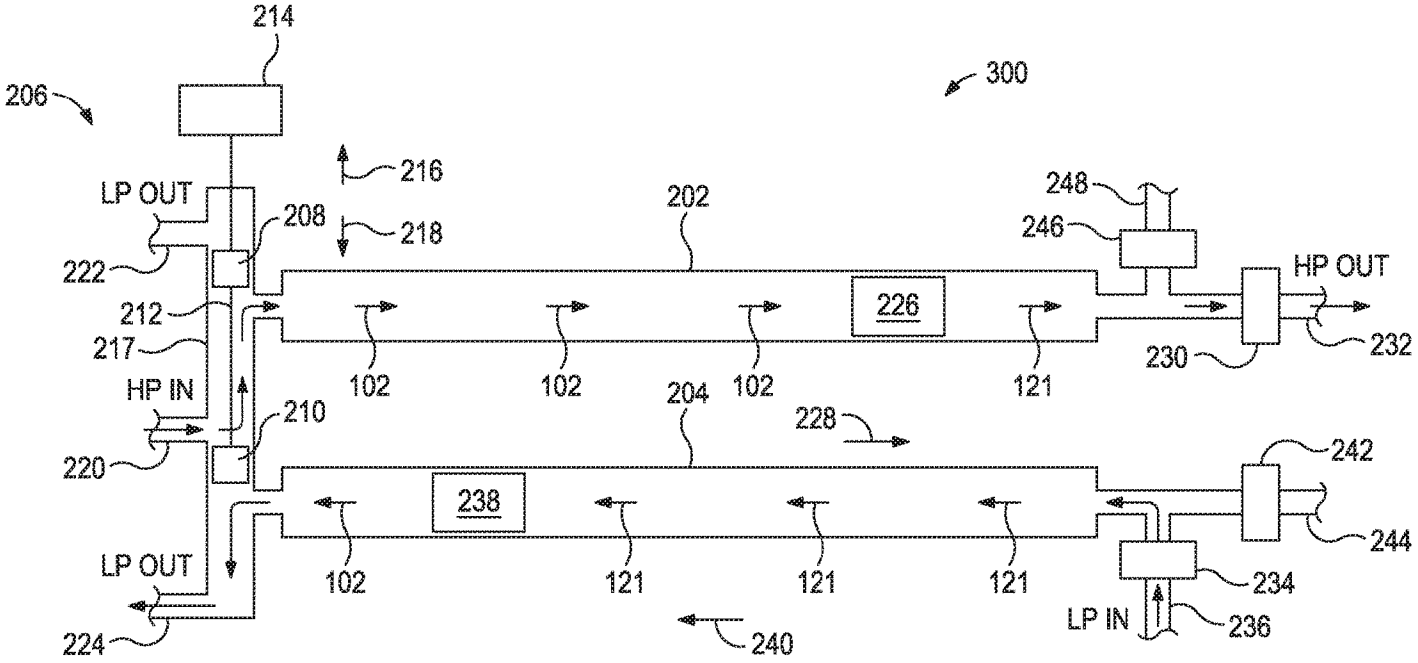
FIG. 13 illustrates a schematic diagram of a reciprocating isobaric pressure exchanger in a first operating position.
Figure 14:
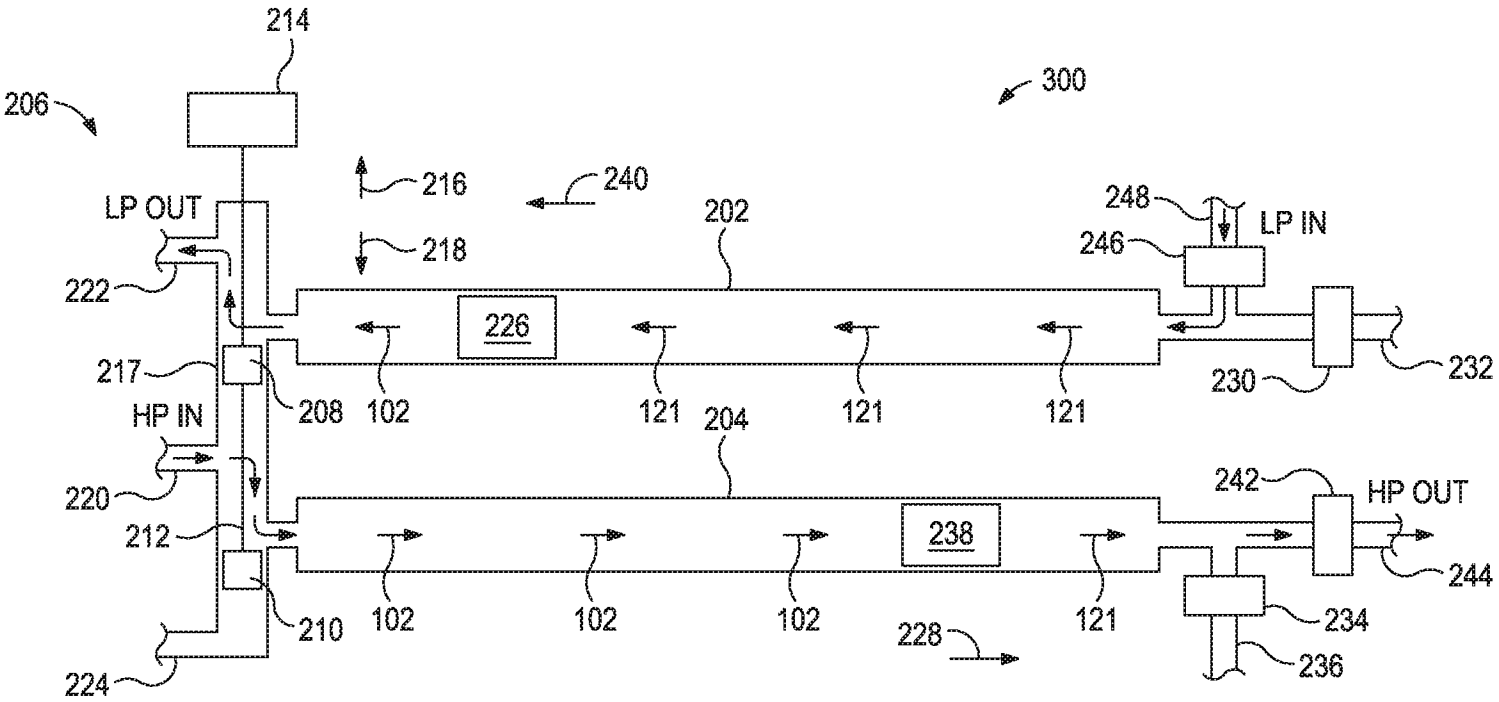
FIG. 14 illustrates a schematic diagram of the reciprocating isobaric pressure exchanger of FIG. 7 in a second operating position.

FIGS. 13 and 14 illustrate a schematic diagram of an example reciprocating IPX 300, which may be used as the hydraulic energy transfer system 110 in FIG. 1. Similar to the rotary IPX 200 described above, the reciprocating IPX 300 is configured to transfer pressure and/or work between the clean fluid 102 and the proppant slurry 121. The following description of the reciprocating IPX 300 is related to a balanced-displacement mode of operation, but the reciprocating IPX 300 may alternatively be operated in an under-displacement mode of operation.

As illustrated, the reciprocating IPX 300 may include first and second pressure vessels 202, 204 that alternatingly transfer pressure from the high-pressure clean fluid 102 to the proppant slurry 121 using a flow control valve 206. It should be noted that the number of pressure vessels in the reciprocating IPX 300 is not limited to two, and any number of pressure vessels can be used in the reciprocating IPX 300, without departing from the scope of the disclosure. The flow control valve 206 includes a first piston 208, a second piston 210, and a shaft 212 that couples the first piston 208 to the second piston 210 and to a reciprocating drive 214 (e.g., a reciprocating electric motor, a reciprocating hydraulic motor, a reciprocating combustion motor, etc.). The reciprocating drive 214 may be used as the drive 134 illustrated in FIG. 1. The reciprocating drive 214 actuates (open and close) the flow control valve 206 by driving the flow control valve 206 in alternating axial directions 216 and 218 within a piston chamber 217 to control the flow of the clean fluid 102 entering through the high-pressure inlet 220.

In a first position illustrated in FIG. 13, for example, the first and second pistons 208 and 210 are positioned within the piston chamber 217 to direct the high-pressure clean fluid 102 into the first pressure vessel 202, while blocking the flow of high-pressure (HP) clean fluid 102 into the second pressure vessel 204 or out of the flow control valve 206 through the low-pressure outlets 222 and 224. As the HP clean fluid 102 enters the first pressure vessel 202 via the piston chamber 217, the clean fluid 102 drives a first fluid separator 226 movably arranged within the first pressure vessel 202 in a first axial direction 228, which increases the pressure of the proppant slurry 121 within the first pressure vessel 202. The first fluid separator 226 may be a piston (hereafter referred to as a pressure vessel piston 226) made of a solid material that can provide the desired performance during operation of the reciprocating IPX 300. For instance, the solid material may be or include a corrosion resistant metal, such as (Inconel, stainless steel, and the like), a ceramic, or a polymer. Once the proppant slurry 121 reaches the appropriate pressure, a high-pressure check valve 230 in fluid communication with the first pressure vessel 202 opens to enable all the HP proppant slurry 121 to exit the reciprocating IPX 300 through a high-pressure outlet 232. For instance, the controller 133 (FIG. 1) may monitor the flow of the HP clean fluid 102 entering the first pressure vessel 202 and the pressure of the proppant slurry 121 in the first pressure vessel 202, and open the high-pressure check valve 230 once the proppant slurry 121 reaches the appropriate pressure. The HP proppant slurry 121 may then be injected into a subterranean formation via the wellhead installation 140 (FIG. 1) for performing hydraulic fracturing operations.

While the first pressure vessel 202 discharges the HP proppant slurry 121, the LP proppant slurry 121 enters the second pressure vessel 204 through a low-pressure check valve 234 fluidly coupled to a low-pressure second fluid inlet 236. For instance, the controller 133 (FIG. 1) may operate the low-pressure check valve 234 to permit the LP proppant slurry 121 to enter the second pressure vessel 204. As the proppant slurry 121 fills the second pressure vessel 204, the proppant slurry 121 drives a second fluid separator 238 in axial direction 240 forcing LP clean fluid 102 out of the second pressure vessel 204 and out of the flow control valve 206 through a low-pressure outlet 224. The second pressure vessel 204 is now prepared to receive HP clean fluid 102. Similar to the first fluid separator 226, the second fluid separator 238 may be a piston (hereafter referred to as a pressure vessel piston 238) also made of a solid material that can provide the desired performance during operation of the reciprocating IPX 300. For instance, the solid material may be or include a corrosion resistant metal, such as (Inconel, stainless steel, and the like), a ceramic, or a polymer.

In FIG. 14, the flow control valve 206 is shown in a second position to direct the HP clean fluid 102 into the second pressure vessel 204, while blocking the flow of HP clean fluid 102 into the first pressure vessel 202, or out of flow control valve 206 through the low-pressure outlets 222 and 224. As the HP clean fluid 102 enters the second pressure vessel 204, the clean fluid 102 drives the pressure vessel piston 238 in the first axial direction 228 to increase the pressure of the proppant slurry 121 within the second pressure vessel 204. Once the proppant slurry 121 reaches the appropriate pressure, a high-pressure check valve 242 opens to enable all the HP proppant slurry 121 to exit the reciprocating IPX 300 through a high-pressure outlet 244. For instance, the controller 133 (FIG. 1) may monitor the flow of the HP clean fluid 102 entering the second pressure vessel 204 and the pressure of the proppant slurry 121 in the second pressure vessel 204, and open the high-pressure check valve 242 once the proppant slurry 121 reaches the appropriate pressure. The HP proppant slurry 121 is injected into a subterranean formation via the wellhead installation 140 (FIG. 1) for performing hydraulic fracturing operations.

While the second pressure vessel 204 discharges, the first pressure vessel 202 fills with the proppant slurry 121 passing through a low-pressure check valve 246 coupled to a low-pressure second fluid inlet 248. For instance, the controller 133 (FIG. 1) may operate the low-pressure check valve 246 to permit the LP proppant slurry 121 to enter the first pressure vessel 202. As the proppant slurry 121 fills the first pressure vessel 202, the proppant slurry 121 drives the pressure vessel piston 226 in a second axial direction 240 forcing LP clean fluid 102 out of the first pressure vessel 202 and out through the low-pressure outlet 222. In this manner, the reciprocating IPX 300 alternatingly transfers pressure from the clean fluid 102 to the proppant slurry 121 using the first and second pressure vessels 202, 204, while isolating the clean fluid 102 and the proppant slurry 121 from each other using the pressure vessel pistons 226 and 238.

During operation, the timing (e.g., the timing of opening and closing) of the flow control valve 206 and of the high-pressure check valves 230 and 242 is accurately controlled (e.g., using the controller 133 of FIG. 1) to prevent the pressure vessel pistons 226 and 238 from contacting the ends of the first and second pressure vessels 202, 204. However, due to fluctuations in operating conditions, the pressure vessel pistons 226 and 238 often contact the ends of the first and second pressure vessels 202 and 204, and, given their high translational speed, can cause significant damage to the reciprocating IPX 300. In addition, if the pressure vessel pistons 226 and 238 were to be suddenly brought to a stop, pressure in the reciprocating IPX 300 may rapidly increase and an overpressure event may result in an unsafe operating environment. These drawbacks can be overcome by replacing the solid fluid separators (i.e., the pressure vessel pistons 226 and 238) with a fluid plug (i.e., the fluid plug 201 of FIG. 2) in each of the first and second pressure vessels 202, 204 to separate the clean fluid 102 and the proppant slurry 121 and operating the reciprocating IPX 300 in an under-displacement mode.

Figure 15:
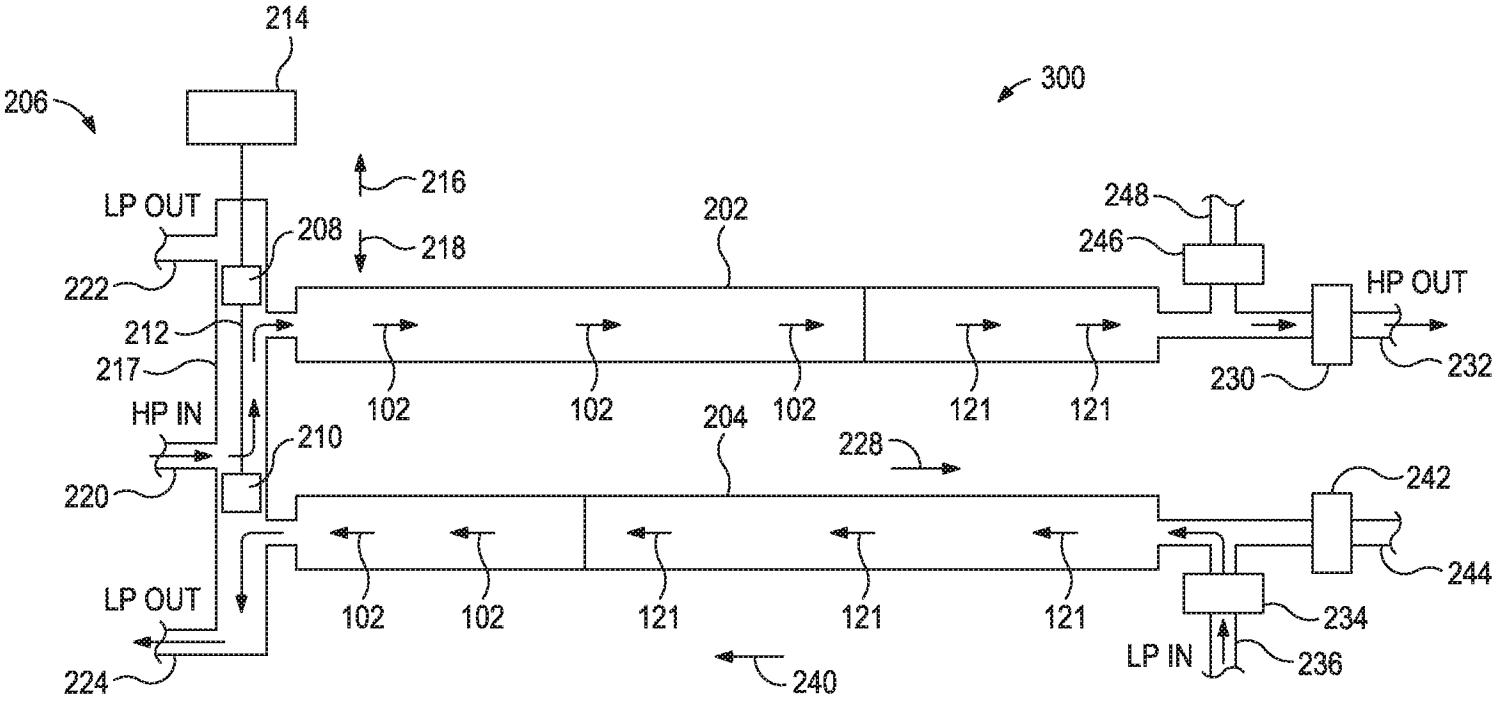
FIGS. 15-18 are progressive views of the reciprocating isobaric pressure exchanger (reciprocating IPX) of FIG. 7 during an under-displacement mode of operation and illustrate the sequence of positions of the channel of the reciprocating IPX.
Figure 16:
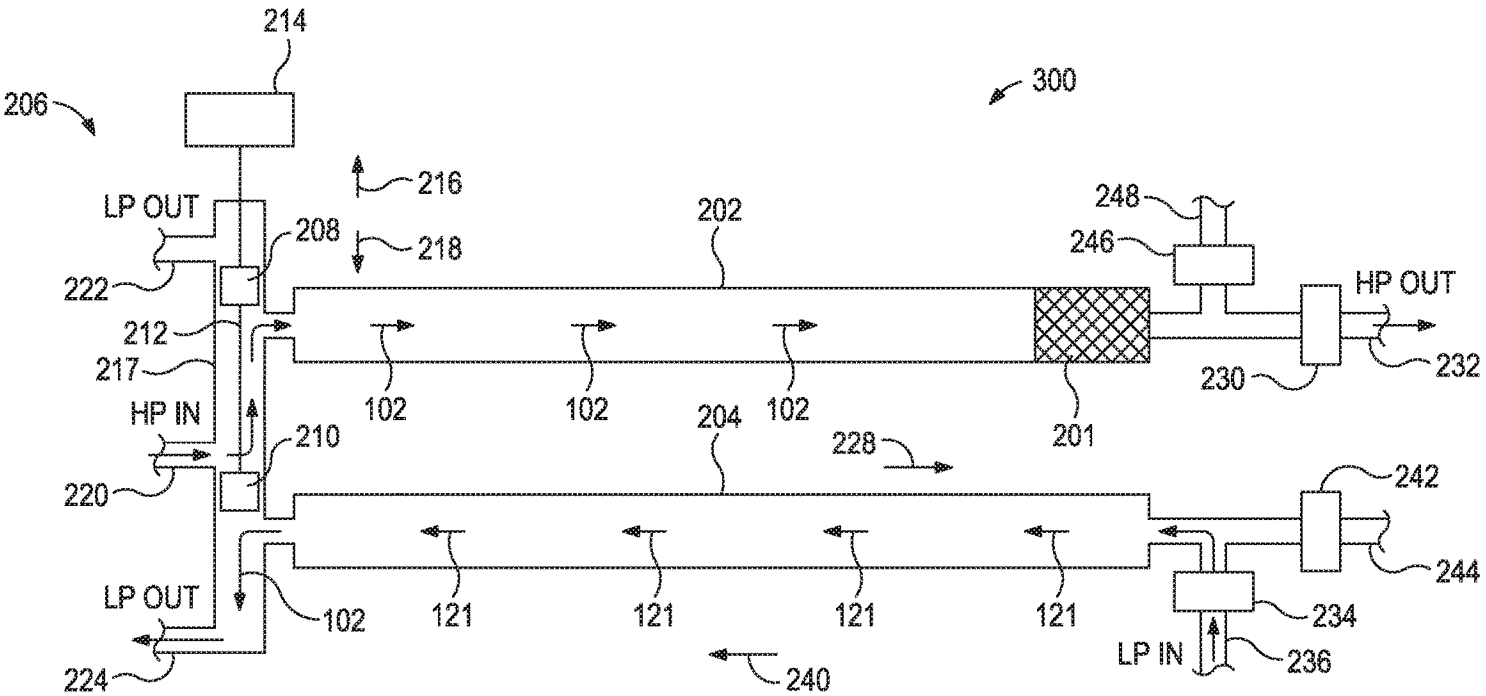

FIGS. 15-18 illustrate a schematic diagram of the reciprocating IPX 300 and an under-displacement mode of operation. The pressure vessel pistons 226 and 238 are omitted from the reciprocating IPX 300, and, therefore, the clean fluid 102 and the proppant slurry 121 contact each other in the first and second pressure vessels 202, 204. Referring to FIGS. 15 and 16, in the first position illustrated therein, the first and second pistons 208 and 210 are positioned within the piston chamber 217 to direct the HP clean fluid 102 into the first pressure vessel 202, while blocking the flow of HP clean fluid 102 into the second pressure vessel 204 or out of the flow control valve 206 through the low-pressure outlets 222 and 224. As the HP clean fluid 102 enters the first pressure vessel 202 via the piston chamber 217, the clean fluid 102 drives the proppant slurry 121 in the first axial direction 228, which increases the pressure of the proppant slurry 121 within the first pressure vessel 202. Once the proppant slurry 121 reaches the appropriate pressure, the high-pressure check valve 230 in fluid communication with the first pressure vessel 202 opens to enable the HP proppant slurry 121 to exit the reciprocating IPX 300 through the high-pressure outlet 232. As mentioned above, the high-pressure check valve 230 may be controlled using the controller 133 (FIG. 1). The HP proppant slurry 121 discharged from the reciprocating IPX 300 may then be used for various wellbore operations, as discussed above.

However, not all the HP proppant slurry 121 is discharged from the reciprocating IPX 300 through the first pressure vessel 202. The high-pressure check valve 230 shuts off the discharge of the HP proppant slurry 121 such that a desired amount of the proppant slurry 121 remains in the first pressure vessel 202. In some examples, the high-pressure check valve 230 is shut off such that an amount of the proppant slurry 121 sufficient to create the fluid plug 201 having an axial extent between about 5% to about 25% of the length of the first pressure vessel 202 remains in the first pressure vessel 202. In other examples, in addition to shutting off the high-pressure check valve 230, the flow control valve 206 may also be actuated into the second position to stop the flow of clean fluid 102 into the first pressure vessel 202 to retain the desired amount of proppant slurry 121 in the first pressure vessel 202.

While the first pressure vessel 202 discharges the HP proppant slurry 121, the LP proppant slurry 121 enters the second pressure vessel 204 through a low-pressure check valve 234 fluidly coupled to a low-pressure second fluid inlet 236. As the proppant slurry 121 fills the second pressure vessel 204, the proppant slurry 121 contacts the clean fluid 102 in the second pressure vessel 204. The proppant slurry 121 drives the clean fluid 102 in axial direction 240 forcing LP clean fluid 102 out of the second pressure vessel 204 and out of the flow control valve 206 through a low-pressure outlet 224. The second pressure vessel 204 is now prepared to receive HP clean fluid 102.

FIG. 16 illustrates the first pressure vessel 202 containing the fluid plug 201 formed from the portion of the proppant slurry 121 remaining in the first pressure vessel 202, and the second pressure vessel 204 containing the proppant slurry 121.

Figure 17:
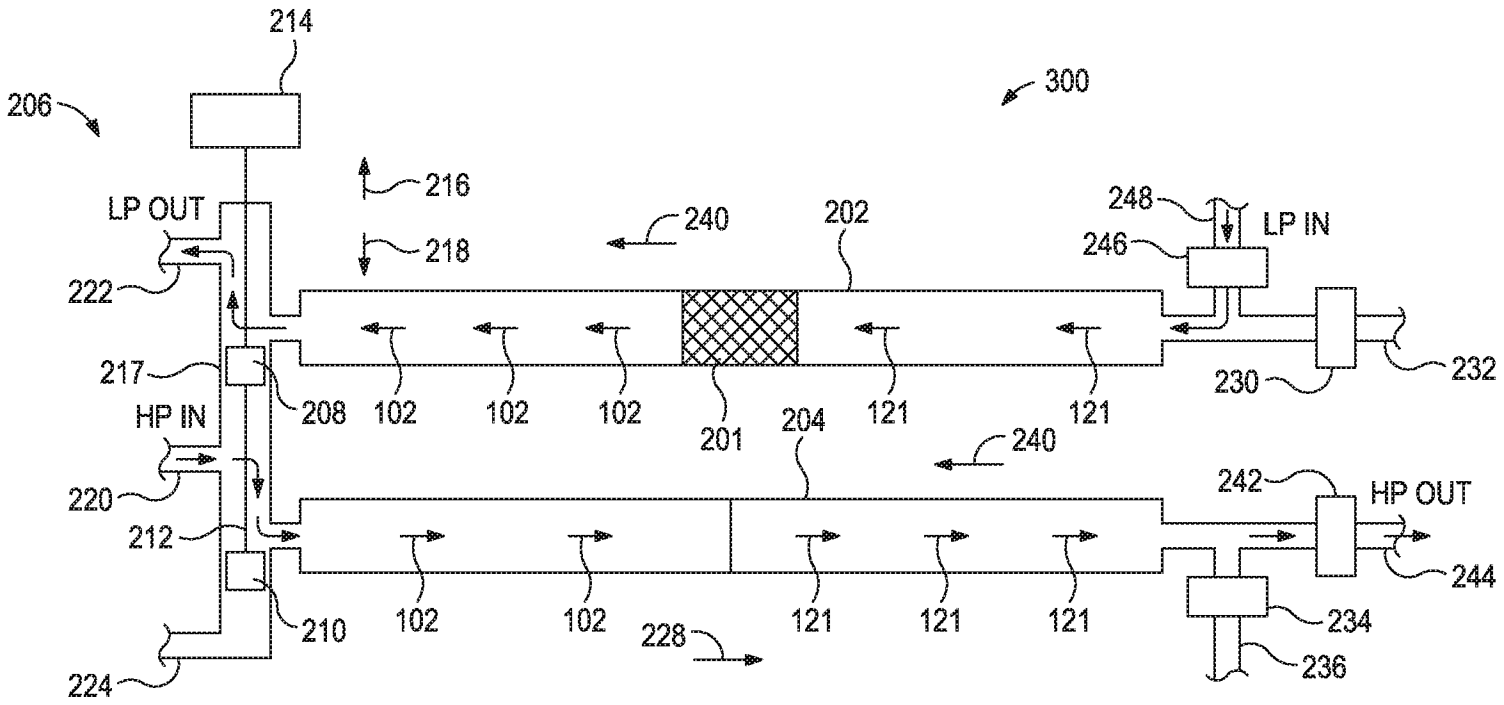
Figure 18:
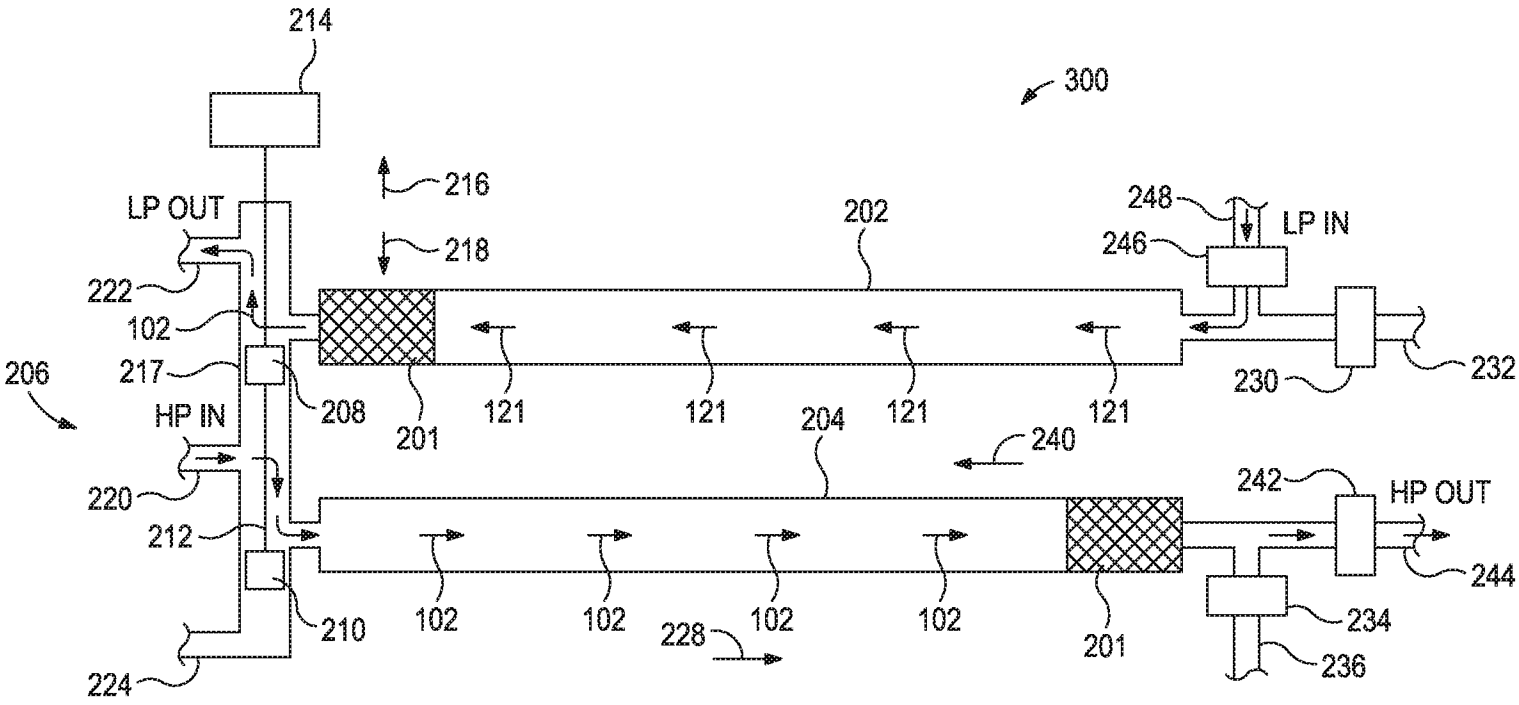

FIGS. 17 and 18 depict the flow control valve 206 in the second position to direct the HP clean fluid 102 into the second pressure vessel 204, while blocking the flow of HP clean fluid 102 into the first pressure vessel 202, or out of flow control valve 206 through the low-pressure outlets 222 and 224. As the HP clean fluid 102 enters the second pressure vessel 204, the clean fluid 102 drives the proppant slurry 121 in the first axial direction 228 to increase the pressure of the proppant slurry 121 within the second pressure vessel 204. Once the proppant slurry 121 reaches the appropriate pressure, the high-pressure check valve 242 in fluid communication with the second pressure vessel 204 opens to enable HP proppant slurry 121 to exit the reciprocating IPX 300 through the high-pressure outlet 244. The high-pressure check valve 242 may be controlled using the controller 133 (FIG. 1). The HP proppant slurry 121 discharged from the reciprocating IPX 300 may then be injected into a subterranean formation via the wellhead installation 140 (FIG. 1) for performing hydraulic fracturing operations.

However, not all the HP proppant slurry 121 is discharged from the second pressure vessel 204. The high-pressure check valve 242 shuts off the discharge of the HP proppant slurry 121 such that a portion of the proppant slurry 121 remains in the second pressure vessel 204. In some examples, the high-pressure check valve 242 is shut off such that an amount of the proppant slurry 121 sufficient to create the fluid plug 201 having an axial extent between about 5% to about 25% of the length of the second pressure vessel 204 remains in the second pressure vessel 204. In other examples, in addition to shutting off the high-pressure check valve 242, the flow control valve 206 may also be actuated into the first position to stop the flow of clean fluid 102 into the second pressure vessel 204 to retain the desired amount of proppant slurry 121 in the second pressure vessel 204.

While the second pressure vessel 204 discharges the HP proppant slurry 121, the first pressure vessel 202 fills with the proppant slurry 121 passing through a low-pressure check valve 246 coupled to a low-pressure second fluid inlet 248. As the proppant slurry 121 fills the first pressure vessel 202, the proppant slurry 121 drives the fluid plug 201 in the second axial direction 240 forcing LP clean fluid 102 out of the first pressure vessel 202 and out through the low-pressure outlet 222. However, the fluid plug 201 is not discharged from the first pressure vessel 202. Specifically, the low-pressure check valve 246 shuts off the supply of the proppant slurry 121 into the first pressure vessel 202 to prevent the fluid plug 201 from being discharged. In other examples, the flow control valve 206 may additionally move to the first position to prevent the fluid plug 201 from being discharged. The first pressure vessel 202 is now prepared to receive HP clean fluid 102. FIG. 18 illustrates the first and second pressure vessels 202, 204 each containing a fluid plug 201. The flow control valve 206 then moves to the first position in FIGS. 15 and 16, and the process repeats.

As the operation of the reciprocating IPX 300 progresses, the viscosity of the fluid plug 201 increases and the fluid plug 201 attains a viscosity higher than the viscosities of the proppant slurry 121 and the clean fluid 102 in the first and second pressure vessels 202, 204. Because of the higher viscosity, the fluid plug 201 impedes mixing of the proppant slurry 121 and the clean fluid 102 in the first and second pressure vessels 202, 204 during operation of the reciprocating IPX 300. In this manner, the reciprocating IPX 300 alternatingly transfers pressure from the clean fluid 102 to the proppant slurry 121 using the first and second pressure vessels 202, 204, while minimizing mixing of the clean fluid 102 and the proppant slurry 121 using the fluid plugs 201.

Initially, during the operation of the rotary IPX 200 and the reciprocating IPX 300, the clean fluid 102 and the proppant slurry 121 may mix in the channels 170 or the first and second pressure vessels 202, 204 before the formation of the fluid plug 201. Therefore, the rotary IPX 200 and the reciprocating IPX 300 may operate with a reduced volumetric efficiency since the rotational speed of the rotor 146 or the valve timing of the flow control valve 206 (or one or more of the check valves 230, 234, 242, and 246) is controlled so that stroke length of the fluid plug 201 is reduced and the fluid plug 201 is retained in the channels 170 or the first and second pressure vessels 202, 204. However, once the fluid plug 201 of a desired viscosity is formed, the rotation of the rotor 146 is reduced or the valve timing of the flow control valve 206 (or one or more of the check valves 230, 234, 242, and 246) is adjusted to increase the stroke length of the fluid plug 201, thereby increasing the volumetric efficiency of the rotary IPX 200 and the reciprocating IPX 300. The fluid plug 201 provides a stable barrier between the clean fluid 102 and the proppant slurry 121 to prevent mixing of the clean fluid 102 and the proppant slurry 121.

In some examples, a breaker fluid may be circulated in one or both of the rotary IPX 200 and the reciprocating IPX 300 to reduce the viscosity of the fluid plug 201 in order to remove the fluid plug 201. In other examples, a gelling agent that "self-breaks" after a desired time may be added to the proppant slurry 121. In this case, the breaker fluid may not be required to remove the fluid plug 201. The time may be adjusted such that the fluid plug 201 "self-breaks" after operations utilizing the proppant slurry 121 are completed.

Figure 19:
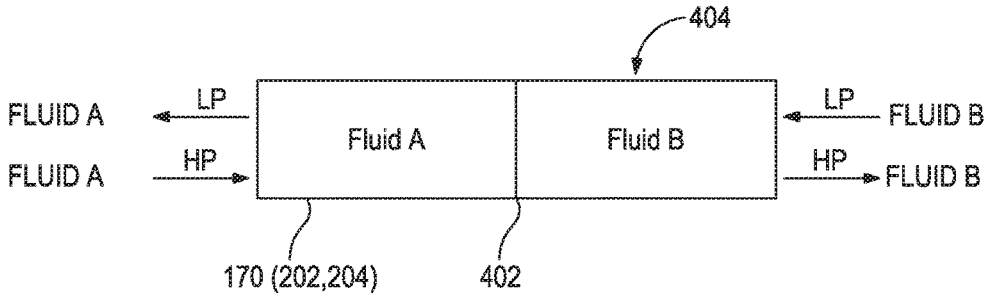
FIG. 19 schematically illustrates a fluid plug formed between two immiscible fluids.

In the operations described above, the clean fluid 102 and the proppant slurry 121 are assumed to be substantially miscible fluids, and the fluid plug 201 minimizes the mixing of the two miscible fluids. FIG. 19 illustrates a fluid plug 402 formed between two immiscible fluids, Fluid A and Fluid B. For example, Fluid A may be a clean fluid and Fluid B may be a proppant slurry in the channel 170 of the rotary IPX 200 (FIG. 3) or in the pressure vessel 202 (or 204) reciprocating IPX 300 (FIGS. 15-18). The fluid plug 402 is formed instantly at the interface 404 of Fluid A and Fluid B upon contact of Fluid A and Fluid B with each other. The fluid plug 402 may be defined by the menisci of Fluid A and Fluid B, which are formed due to the surface tension of the Fluids A and B. The fluid plug 402 may have a substantially smaller axial extent compared to the fluid plug 201. The fluid plug 402, therefore, traverses a substantially greater stroke length of the channels 170 of the rotary IPX 200 or the first and second pressure vessels 202, 204 of the reciprocating IPX 300. The rotary IPX 200 and the reciprocating IPX 300 may thus operate with a relatively higher volumetric efficiency.

Embodiments disclosed herein include:

A. A method that includes introducing a proppant slurry into a first end of a hydraulic energy transfer system, introducing a clean fluid into a second end of the hydraulic energy transfer system opposite the first end, operating the hydraulic energy transfer system to retain a portion of the proppant slurry in the hydraulic energy transfer system while transferring pressure of the clean fluid to the proppant slurry, and forming a fluid plug that separates the proppant slurry and the clean fluid, the fluid plug being formed by increasing a viscosity of the portion of the proppant slurry to be higher than a viscosity of the clean fluid and a viscosity of the proppant slurry in the hydraulic energy transfer system.

B. A system that includes a proppant slurry, a clean fluid, a hydraulic energy transfer system that receives the proppant slurry into a first end of the hydraulic energy transfer system and further receives the clean fluid into a second end opposite the first end of the hydraulic energy transfer system, and a controller including a processor and a non-transitory computer readable medium, the controller being communicatively coupled to the hydraulic energy transfer system and computer readable medium storing a computer readable program code that when executed by the processor causes the controller to: operate the hydraulic energy transfer system to retain a portion of the proppant slurry in the hydraulic energy transfer system while transferring at least a portion of a pressure of the clean fluid to the proppant slurry and to form a fluid plug that separates the proppant slurry and the clean fluid, the fluid plug being formed by increasing a viscosity of the portion of the proppant slurry to be higher than a viscosity of the clean fluid and a viscosity of the proppant slurry in the hydraulic energy transfer system.

C: A method that includes introducing a first fluid into a first end of a hydraulic energy transfer system, introducing a second fluid into a second end of the hydraulic energy transfer system opposite the first end, forming a fluid plug that separates the first and second fluids and minimizes mixing of the first and second fluids in the hydraulic energy transfer system, and transferring pressure of the second fluid to the first fluid using the fluid plug.

Each of embodiments A, B, and C may have one or more of the following additional elements in any combination: Element 1: wherein the hydraulic energy transfer system includes a rotary isobaric pressure exchanger, and the method further comprises controlling a rotational speed of a rotor of the rotary isobaric pressure exchanger to retain the portion of the proppant slurry in a channel of the rotor.

Element 2: wherein controlling the rotational speed of the rotor comprises maintaining the rotational speed of the rotor until the fluid plug of a desired viscosity is formed in the channel and decreasing the rotational speed of the rotor after the fluid plug is formed to increase a stroke length of the fluid plug in the channel. Element 3: further comprising controlling the rotational speed of the rotor such that the fluid plug formed has an axial extent between about 5% to about 25% of a length of the channel of the rotor. Element 4: wherein controlling the rotational speed of the rotor includes controlling the rotational speed using a drive coupled to the rotary isobaric pressure exchanger. Element 5: wherein the hydraulic energy transfer system includes a reciprocating isobaric pressure exchanger, and the method further comprises controlling a valve timing of at least one of a flow control valve and a check valve of the reciprocating isobaric pressure exchanger to retain the portion of the proppant slurry in a pressure vessel of the reciprocating isobaric pressure exchanger. Element 6: wherein controlling the valve timing of the at least one of the flow control valve and the check valve comprises maintaining the valve timing of the at least one of the flow control valve and the check valve until the fluid plug of a desired viscosity is formed in the pressure vessel and adjusting the valve timing of the at least one of the flow control valve and the check valve after the fluid plug is formed to increase a stroke length of the fluid plug in the pressure vessel. Element 7: further comprising controlling the valve timing of the at least one of the flow control valve and the check valve such that the fluid plug formed has an axial extent between about 5% to about 25% of a length of the pressure vessel. Element 8: wherein forming the fluid plug further includes controlling a rate of crosslinking of one or more gelling agents in the portion of the proppant slurry. Element 9: further comprising removing the fluid plug from the hydraulic energy transfer system by circulating a breaker fluid in the hydraulic energy transfer system.

Element 10: further comprising a drive coupled to the hydraulic energy transfer system, wherein the hydraulic energy transfer system includes a rotary isobaric pressure exchanger, and executing the program code further causes the controller to operate the rotary isobaric pressure exchanger by rotating a rotor of the rotary isobaric pressure exchanger using the drive and to control a rotational speed of the rotor to retain the portion of the proppant slurry in a channel of the rotor. Element 11: wherein executing the program code further causes the controller to control the rotational speed of the rotor such that the fluid plug formed has an axial extent between about 5% to about 25% of a length of the channel. Element 12: wherein the hydraulic energy transfer system includes a reciprocating isobaric pressure exchanger, and executing the program code further causes the controller to operate the reciprocating isobaric pressure exchanger by controlling a valve timing of at least one of a flow control valve and a pressure check valve of the reciprocating isobaric pressure exchanger to retain the portion of the proppant slurry in a pressure vessel of the reciprocating isobaric pressure exchanger. Element 13: wherein executing the program code further causes the controller to control the valve timing of the at least one of the flow control valve and the pressure check valve such that the fluid plug formed has an axial extent between about 5% to about 25% of a length of the pressure vessel. Element 14: further comprising fluid additives including one or more gelling agents, wherein executing the program code further causes the controller to control a rate of crosslinking of one or more gelling agents in the proppant slurry to form the fluid plug having a desired viscosity.

Element 15: wherein the first and second fluids are immiscible fluids. Element 16: wherein forming the fluid plug comprises operating the hydraulic energy transfer system to retain a portion of the first fluid in the hydraulic energy transfer system while transferring the pressure of the second fluid to the first fluid, and forming the fluid plug by increasing a viscosity of the retained portion of the first fluid to be higher than a viscosity of the second fluid and a viscosity of the first fluid. Element 17: wherein the first fluid is a proppant slurry having a first pressure and the second fluid is a clean fluid having a second pressure higher than the first pressure.

By way of non-limiting example, exemplary combinations applicable to A, B, and C include: Element 1 with Element 2; Element 1 with Element 3; Element 1 with Element 4; Element 5 with Element 6; Element 6 with Element 7; Element 10 with Element 11; Element 12 with Element 13; and Element 16 with Element 17.

Therefore, the disclosed systems and methods are well adapted to attain the ends and advantages mentioned as well as those that are inherent therein. The examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the illustrative examples disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative examples as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A method, comprising:

introducing a proppant slurry into a first end of a hydraulic energy transfer system;

introducing a clean fluid into a second end of the hydraulic energy transfer system opposite the first end;

operating the hydraulic energy transfer system to retain a portion of the proppant slurry in the hydraulic energy transfer system while transferring pressure of the clean fluid to the proppant slurry; and forming a fluid plug that separates the proppant slurry and the clean fluid, the fluid plug being formed by increasing a viscosity of the portion of the proppant slurry to be higher than a viscosity of the clean fluid and higher than a viscosity of the proppant slurry in the hydraulic energy transfer system.

2. The method of claim 1, wherein the hydraulic energy transfer system includes a rotary isobaric pressure exchanger, and the method further comprises controlling a rotational speed of a rotor of the rotary isobaric pressure exchanger to retain the portion of the proppant slurry in a channel of the rotor.

3. The method of claim 2, wherein controlling the rotational speed of the rotor comprises maintaining the rotational speed of the rotor until the fluid plug of a desired viscosity is formed in the channel and decreasing the rotational speed of the rotor after the fluid plug is formed to increase a stroke length of the fluid plug in the channel.

4. The method of claim 2, further comprising controlling the rotational speed of the rotor such that the fluid plug formed has an axial extent between about 5% to about 25% of a length of the channel of the rotor.

5. The method of claim 2, wherein controlling the rotational speed of the rotor includes controlling the rotational speed using a drive coupled to the rotary isobaric pressure exchanger.

6. The method of claim 1, wherein the hydraulic energy transfer system includes a reciprocating isobaric pressure exchanger, and the method further comprises controlling a valve timing of at least one of a flow control valve and a check valve of the reciprocating isobaric pressure exchanger to retain the portion of the proppant slurry in a pressure vessel of the reciprocating isobaric pressure exchanger.

7. The method of claim 6, wherein controlling the valve timing of the at least one of the flow control valve and the check valve comprises maintaining the valve timing of the at least one of the flow control valve and the check valve until the fluid plug of a desired viscosity is formed in the pressure vessel and adjusting the valve timing of the at least one of the flow control valve and the check valve after the fluid plug is formed to increase a stroke length of the fluid plug in the pressure vessel.

8. The method of claim 6, further comprising controlling the valve timing of the at least one of the flow control valve and the check valve such that the fluid plug formed has an axial extent between about 5% to about 25% of a length of the pressure vessel.

9. The method of claim 1, wherein forming the fluid plug further includes controlling a rate of crosslinking of one or more gelling agents in the portion of the proppant slurry.

10. The method of claim 1, further comprising removing the fluid plug from the hydraulic energy transfer system by circulating a breaker fluid in the hydraulic energy transfer system.

11. A system, comprising;

a proppant slurry;

a clean fluid;

a hydraulic energy transfer system that receives the proppant slurry into a first end of the hydraulic energy transfer system and further receives the clean fluid into a second end opposite the first end of the hydraulic energy transfer system; and a controller including a processor and a non-transitory computer readable medium, the controller being communicatively coupled to the hydraulic energy transfer system and computer readable medium storing a computer readable program code that when executed by the processor directs the controller to:

operate the hydraulic energy transfer system to retain a portion of the proppant slurry in the hydraulic energy transfer system while transferring at least a portion of a pressure of the clean fluid to the proppant slurry and to form a fluid plug that separates the proppant slurry and the clean fluid, the fluid plug being formed by increasing a viscosity of the portion of the proppant slurry to be higher than a viscosity of the clean fluid and higher than a viscosity of the proppant slurry in the hydraulic energy transfer system.

12. The system of claim 11, further comprising a drive coupled to the hydraulic energy transfer system, wherein the hydraulic energy transfer system includes a rotary isobaric pressure exchanger, and executing the program code further directs the controller to operate the rotary isobaric pressure exchanger by rotating a rotor of the rotary isobaric pressure exchanger using the drive and to control a rotational speed of the rotor to retain the portion of the proppant slurry in a channel of the rotor.

13. The system of claim 12, wherein executing the program code further directs the controller to control the rotational speed of the rotor such that the fluid plug formed has an axial extent between about 5% to about 25% of a length of the channel.

14. The system of claim 11, wherein the hydraulic energy transfer system includes a reciprocating isobaric pressure exchanger, and executing the program code further directs the controller to operate the reciprocating isobaric pressure exchanger by controlling a valve timing of at least one of a flow control valve and a pressure check valve of the reciprocating isobaric pressure exchanger to retain the portion of the proppant slurry in a pressure vessel of the reciprocating isobaric pressure exchanger.

15. The system of claim 14, wherein executing the program code further directs the controller to control the valve timing of the at least one of the flow control valve and the pressure check valve such that the fluid plug formed has an axial extent between about 5% to about 25% of a length of the pressure vessel.

16. The system of claim 11, further comprising fluid additives including one or more gelling agents, wherein executing the program code further directs the controller to control a rate of crosslinking of one or more gelling agents in the proppant slurry to form the fluid plug having a desired viscosity.

17. A method, comprising:

introducing a first fluid into a first end of a hydraulic energy transfer system;

introducing a second fluid into a second end of the hydraulic energy transfer system opposite the first end;

forming a fluid plug that separates the first and second fluids and minimizes mixing of the first and second fluids in the hydraulic energy transfer system, the fluid plug having a viscosity higher than a viscosity of the first fluid and higher than a viscosity of the second fluid; and transferring pressure of the second fluid to the first fluid using the fluid plug.

18. The method of claim 17, wherein the first and second fluids are immiscible fluids.

19. The method of claim 17, wherein forming the fluid plug comprises:

operating the hydraulic energy transfer system to retain a portion of the first fluid in the hydraulic energy transfer system while transferring the pressure of the second fluid to the first fluid; and forming the fluid plug by increasing a viscosity of the retained portion of the first fluid.

20. The method of claim 19, wherein the first fluid is a proppant slurry having a first pressure and the second fluid is a clean fluid having a second pressure higher than the first pressure.

* * * * *